US010327069B2

(12) United States Patent
Fishman et al.

(10) Patent No.: US 10,327,069 B2
(45) Date of Patent: Jun. 18, 2019

(54) LASER MICROPHONE UTILIZING SPECKLES NOISE REDUCTION

(71) Applicant: VocalZoom Systems Ltd., Yokneam Illit (IL)

(72) Inventors: Tal Fishman, Haifa (IL); Alexander Blumkin, Nazareth Illit (IL); Reuven Elhamias, Kfar Vradim (IL); Gil Levy, Ramot Meir (IL); Tal Bakish, Modi'in (IL)

(73) Assignee: VOCALZOOM SYSTEMS LTD., Yokneam Illit (IL)

( * ) Notice: Subject to any disclaimer, the term of this patent is extended or adjusted under 35 U.S.C. 154(b) by 0 days.

(21) Appl. No.: 15/512,564

(22) PCT Filed: Jul. 21, 2016

(86) PCT No.: PCT/IB2016/054364
§ 371 (c)(1),
(2) Date: Mar. 19, 2017

(87) PCT Pub. No.: WO2017/017572
PCT Pub. Date: Feb. 2, 2017

(65) Prior Publication Data

US 2018/0139534 A1 May 17, 2018

Related U.S. Application Data

(60) Provisional application No. 62/197,023, filed on Jul. 26, 2015, provisional application No. 62/197,106,
(Continued)

(51) Int. Cl.
*H04R 3/00* (2006.01)
*H04R 17/02* (2006.01)
(Continued)

(52) U.S. Cl.
CPC ..... *H04R 3/005* (2013.01); *G10L 21/0216* (2013.01); *H04R 17/02* (2013.01);
(Continued)

(58) Field of Classification Search
USPC ..... 381/13, 71.1, 94.1, 93, 94.9, 85, 96, 95, 381/170, 172, 317
See application file for complete search history.

(56) References Cited

U.S. PATENT DOCUMENTS 6,014,239 A * 1/2000 Veligdan ..... H04B 10/114 381/170
7,775,113 B2 8/2010 Bakish
(Continued)

FOREIGN PATENT DOCUMENTS

WO WO2010113107 10/2010

OTHER PUBLICATIONS

International Search Report for application PCT/IB2016/054364 dated Nov. 17, 2016.

*Primary Examiner* — Yosef K Laekemariam
(74) *Attorney, Agent, or Firm* — Eitan Mehulal Sadot

(57) ABSTRACT

A system includes a laser microphone or laser-based microphone or optical microphone. The laser microphone includes a laser transmitter to transmit an outgoing laser beam towards a face of a human speaker. The laser transmitter acts also as a self-mix interferometry unit that receives the optical feedback signal reflected from the face of the human speaker, and generates an optical self-mix signal by self-mixing interferometry of the laser power and the received optical feedback signal; and a speckles noise reducer to reduce speckles noise and to increase a bandwidth of the optical self-mix signal. The speckles noise reducer optionally includes a vibration unit or displacement unit, to cause vibrations or displacement of one or more mirrors or optics
(Continued)

elements of the laser microphone, to thereby reduce speckles noise. The speckles noise reducer optionally includes a dynamic laser modulation modifier unit, to dynamically modify modulation properties of a laser modulator associated with the laser transmitter; optionally by modifying an operating temperature of the laser. Optionally, modifications are performed based on a timing scheme, or based on a pseudo-random scheme, or based on a calibration process that selects an advantageous modification scheme. Optionally, the system detects self-mix signal magnitude or bandwidth or quality, and activates the speckles noise reduction mechanism if the self-mix signal appears to be weak or low-quality.

48 Claims, 4 Drawing Sheets

Related U.S. Application Data filed on Jul. 27, 2015, provisional application No. 62/197,107, filed on Jul. 27, 2015, provisional application No. 62/197,108, filed on Jul. 27, 2015.

(51) Int. Cl.

| | |
|---|---|
| ***H04R 19/04*** | (2006.01) |
| ***H04R 23/00*** | (2006.01) |
| ***H04R 23/02*** | (2006.01) |
| ***G10L 21/0216*** | (2013.01) |

(52) U.S. Cl.

CPC ..... *H04R 19/04* (2013.01); *H04R 23/008* (2013.01); *H04R 23/02* (2013.01); *H04R 2410/05* (2013.01); *H04R 2499/11* (2013.01); *H04R 2499/13* (2013.01); *H04R 2499/15* (2013.01)

(56) References Cited

U.S. PATENT DOCUMENTS

| | | | | |
|---|---|---|---|---|
| 8,286,493 | B2 * | 10/2012 | Bakish | G01H 9/00 73/596 |
| 8,949,118 | B2 | 2/2015 | Avargel et al. | |
| 9,344,811 | B2 | 5/2016 | Bakish | |
| 2016/0300054 | A1 * | 10/2016 | Turgeman | H04L 63/08 |

* cited by examiner

LASER MICROPHONE UTILIZING SPECKLES NOISE REDUCTION

CROSS-REFERENCE TO RELATED APPLICATIONS

This patent application is a National Stage of PCT International Application number PCT/IB2016/054364, having an International Filing Date of Jul. 21, 2016, published as International Publication number WO 2017/017572, which is hereby incorporated by reference in its entirety; which claims priority and benefit from U.S. provisional patent application No. 62/197,023, filed on Jul. 26, 2015, which is hereby incorporated by reference in its entirety.

The above-mentioned PCT international application number PCT/IB2016/054364 also claims priority and benefit from U.S. provisional patent application No. 62/197,106, filed on Jul. 27, 2015, which is hereby incorporated by reference in its entirety.

The above-mentioned PCT international application number PCT/IB2016/054364 also claims priority and benefit from U.S. provisional patent application No. 62/197,107, filed on Jul. 27, 2015, which is hereby incorporated by reference in its entirety.

The above-mentioned PCT international application number PCT/IB2016/054364 also claims priority and benefit from U.S. provisional patent application No. 62/197,108, filed on Jul. 27, 2015, which is hereby incorporated by reference in its entirety.

FIELD

The present invention is related to processing of signals.

BACKGROUND

Audio and acoustic signals are captured and processed by millions of electronic devices. For example, many types of smartphones, tablets, laptop computers, and other electronic devices, may include an acoustic microphone able to capture audio. Such devices may allow the user, for example, to capture an audio/video clip, to record a voice message, to speak telephonically with another person, to participate in telephone conferences or audio/video conferences, to verbally provide speech commands to a computing device or electronic device, or the like.

SUMMARY

The present invention may include, for example, systems, devices, and methods for enhancing and processing audio signals, acoustic signals and/or optical signals.

The present invention may comprise a laser microphone or laser-based microphone or optical microphone. For example, the laser microphone includes a laser transmitter to transmit an outgoing laser beam towards a face of a human speaker; a self-mix interferometry unit to receive an optical feedback signal reflected from the face of the human speaker, and to generate an optical self-mix signal by self-mixing interferometry of the outgoing laser beam and the received optical feedback signal; and a speckles noise reducer to reduce speckles noise and to increase a bandwidth of the optical self-mix signal. The speckles noise reducer optionally includes a vibration unit or displacement unit, to cause vibrations or displacement of one or more mirrors or optics elements of the laser microphone, to thereby reduce speckles noise. The speckles noise reducer optionally includes a dynamic modulation modifier unit, to dynamically modify modulation of a laser modulator associated with the laser transmitter; optionally by modifying an operating temperature of the laser modulator. Optionally, the above-mentioned modification(s) may be performed based on a timing scheme, or based on a pseudo-random scheme; or based on a calibration process that selects an advantageous modification scheme out of two or more attempted modification schemes. Optionally, the system detects self-mix signal magnitude or bandwidth or quality, and activates the speckles noise reduction mechanism if the self-mix signal appears to be weak or low-quality (e.g., below a threshold value of quality, efficiency, usefulness, bandwidth, or other suitable self-mix signal quality indicator or quality score).

The present invention may provide other and/or additional benefits or advantages.

DETAILED DESCRIPTION OF THE PRESENT INVENTION

Applicants have realized that an optical microphone, or a laser-based microphone or a laser microphone, may be utilized in order to enhance or improve an acoustic signal that is captured or sensed by acoustic microphone(s), or in order to reduce noise from (or to digitally filter) such acoustic signal(s), or in order to achieve other goals.

Figure 1:
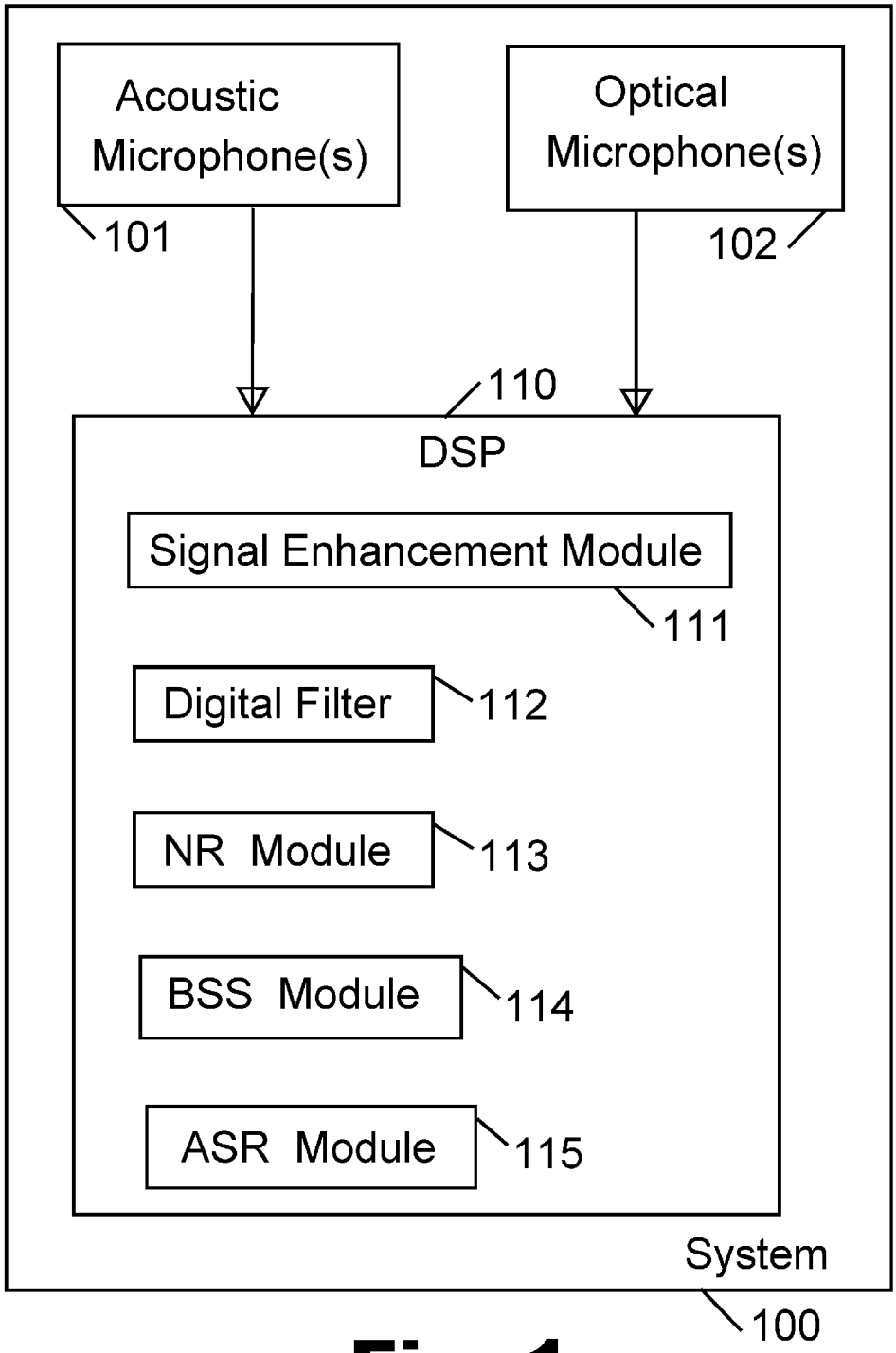
FIG. 1 is a schematic block-diagram illustration of a system, in accordance with some demonstrative embodiments of the present invention.

Reference is made to FIG. 1, which is a schematic block-diagram illustration of a system 100 in accordance with some demonstrative embodiments of the present invention. System 100 may be implemented as part of, for example: an electronic device, a smartphone, a tablet, a gaming device, a video-conferencing device, a telephone, a vehicular device, a vehicular system, a vehicular dashboard device, a navigation system, a mapping system, a gaming system, a portable device, a non-portable device, a computer, a laptop computer, a notebook computer, a tablet computer, a server computer, a handheld device, a wearable device, an Augmented Reality (AR) device or helmet or glasses or headset (e.g., similar to Google Glass), a Virtual Reality (VR) device or helmet or glasses or headset (e.g., similar to Oculus Rift), a smart-watch, a machine able to receive voice commands or speech-based commands, a speech-to-text converter, a Voice over Internet Protocol (VoIP) system or device, wireless communication devices or systems, wired communication devices or systems, image processing and/or video processing and/or audio processing workstations or servers or systems, electro-encephalogram (EEG) systems, medical devices or systems, medical diagnostic devices and/or systems, medical treatment devices and/or systems, and/or other suitable devices or systems. In some embodiments, system 100 may be implemented as a stand-alone unit or "chip" or module or device, able to capture audio and able to output enhanced audio, clean audio, noise-reduced audio, or otherwise improved or modified audio. System 100 may be implemented by utilizing one or more hardware components and/or software modules.

System 100 may comprise, for example: one or more acoustic microphone(s) 101; and one or more optical microphone(s) 102. Each one of the optical microphone(s) 102 may be or may comprise, for example, a laser-based microphone; which may include, for example, a laser-based transmitter (for example, to transmit a laser beam, e.g., towards a face or a mouth-area of a human speaker or human user, or towards other area-of-interest), an optical sensor to capture optical feedback returned from the area-of-interest; and an optical feedback processor to process the optical feedback and generate a signal (e.g., a stream of data; a data-stream; a data corresponding or imitating or emulating n audio signal or an acoustic signal) that corresponds to that optical feedback.

The acoustic microphone(s) 101 may capture or sense or acquire one or more acoustic signal(s); and the optical microphone(s) 102 may capture or sense or acquire one or more optical signal(s). The signals may be utilized by a digital signal processor (DSP) 110, or other controller or processor or circuit or Integrated Circuit (IC). For example, the DSP 110 may comprise, or may be implemented as, a signal enhancement module 111 able to enhance or improve the acoustic signal based on the receives signal; a digital filter 112 able to filter the acoustic signal based on the received signals; a Noise Reduction (NR) module 113 able to reduce noise from the acoustic signal based on the received signals; a Blind Source Separation (BSS) module 114 able to separate or differentiate among two or more sources of audio, based on the received signals; a Speech Recognition (SR) or Automatic Speech Recognition (ASR) module 115 able to recognize spoken words based on the received signals; and/or other suitable modules or sub-modules.

In the discussion herein, the output generated by (or the signals captured by, or the signals processed by) an Acoustic microphone, may be denoted as "A" for Acoustic.

In the discussion herein, the output generated by (or the signals captured by, or the signals processed by) an Optical (or laser-based) microphone, may be denoted as "0" for Optical.

Although portions of the discussion herein may relate to, and although some of the drawings may depict, a single acoustic microphone, or two acoustic microphones, it is clarified that these are merely non-limiting examples of some implementations of the present invention. The present invention may be utilized with, or may comprise or may operate with, other number of acoustic microphones, or a batch or set or group of acoustic microphones, or a matrix or array of acoustic microphones, or the like.

Although portions of the discussion herein may relate to, and although some of the drawings may depict, a single optical (laser-based) microphone, or two optical (laser-based) microphones, it is clarified that these are merely non-limiting examples of some implementations of the present invention. The present invention may be utilized with, or may comprise or may operate with, other number of optical or laser-based microphones, or a batch or set or group of optical or laser-based microphones, or a matrix or array of optical or laser-based microphones, or the like.

Although portions of the discussion herein may relate, for demonstrative purposes, to two "sources" (e.g., two users, or two speakers, or a user and a noise, or a user and interference), the present invention may be used in conjunction with a system having a single source, or having two such sources, or having three or more such sources (e.g., one or more speakers, and/or one or more noise sources or interference sources).

Figure 2:
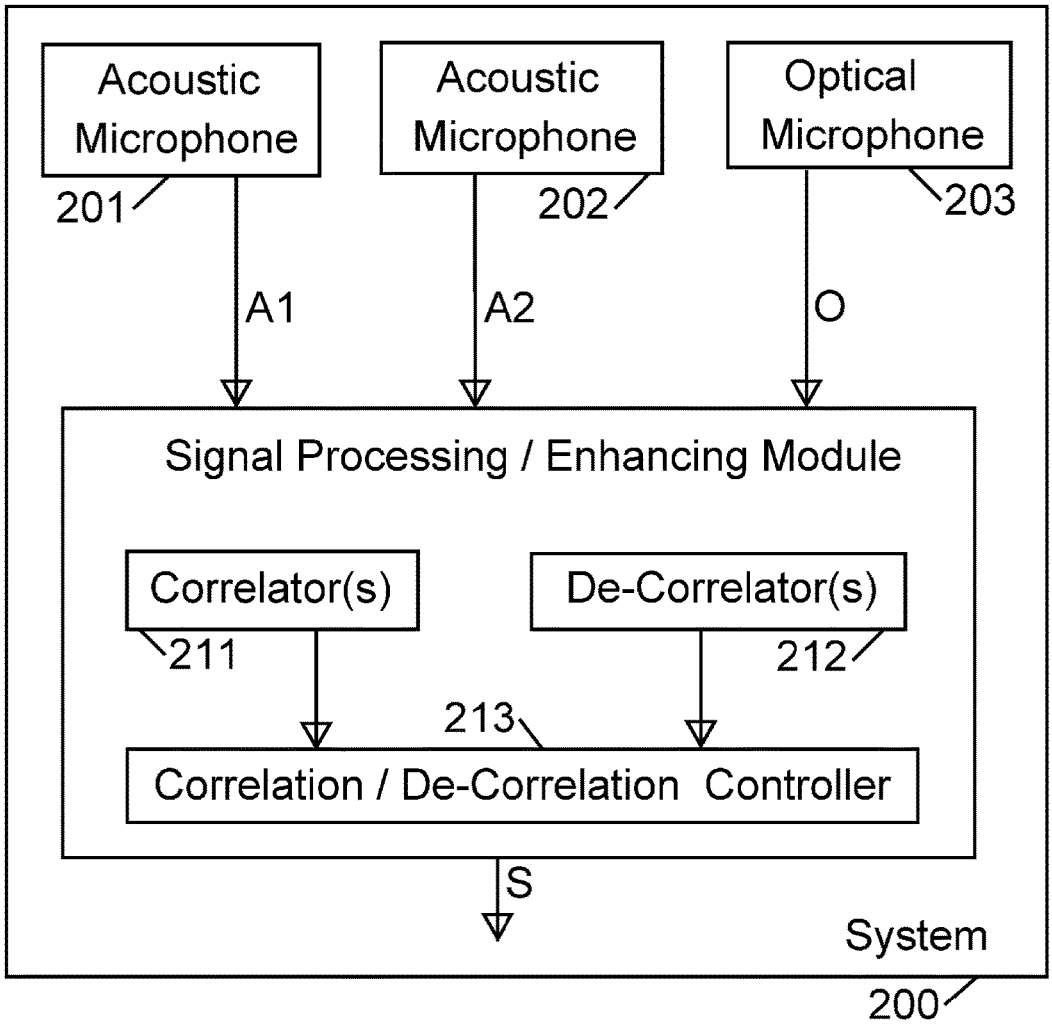
FIG. 2 is a schematic block-diagram illustration of another system, in accordance with some demonstrative embodiments of the present invention.

Reference is made to FIG. 2, which is a schematic block-diagram illustration of a system 200 in accordance with some demonstrative embodiments of the present invention. Optionally, system 200 may be a particular implementation of system 100 of FIG. 1.

System 200 may comprise a plurality of acoustic microphones; for example, a first acoustic microphone 201 able to generate a first signal A1 corresponding to the audio captured by the first acoustic microphone 201; and a second acoustic microphone 202 able to generate a second signal A2 corresponding to the audio captured by the second acoustic microphone 202. System 200 may further comprise one or more optical microphones; for example, an optical microphone 203 aimed towards an area-of-interest, able to generate a signal O corresponding to the optical feedback captured by the optical microphone 203.

A signal processing/enhancing module 210 may receive as input: the first signal A1 of the first acoustic microphone 201, and the second signal A2 of the second acoustic microphone, and the signal O from the optical microphone. The signal processing/enhancing module 210 may comprise one or more correlator(s) 211, and/or one or more decorrelators 212; which may perform one or more, or a set or series or sequence of, correlation operations and/or decorrelation operations, on the received signals or on some of them or on combination(s) of them, as described herein, based on correlation/decorrelation logic implemented by a correlation/decorrelation controller 213; in order to achieve a particular goal, for example, to reduce noise(s) from acoustic signal(s), to improve or enhance or clean the acoustic signal(s), to distinguish or separate or differentiate among sources of acoustic signals or among speakers, to distinguish or separate or differentiate between a speaker (or multiple speakers) and noise or background noise or ambient noise, to operate as digital filter on one or more of the received signals, and/or to perform other suitable operations. The signal processing/enhancing module 210 may output an enhanced reduced-noise signal S, which may be utilized for such purposes and/or for other purposes, by other units or modules or components of system 200, or by units or components or modules which may be external to (and/or remote from) system 200.

Figure 3:
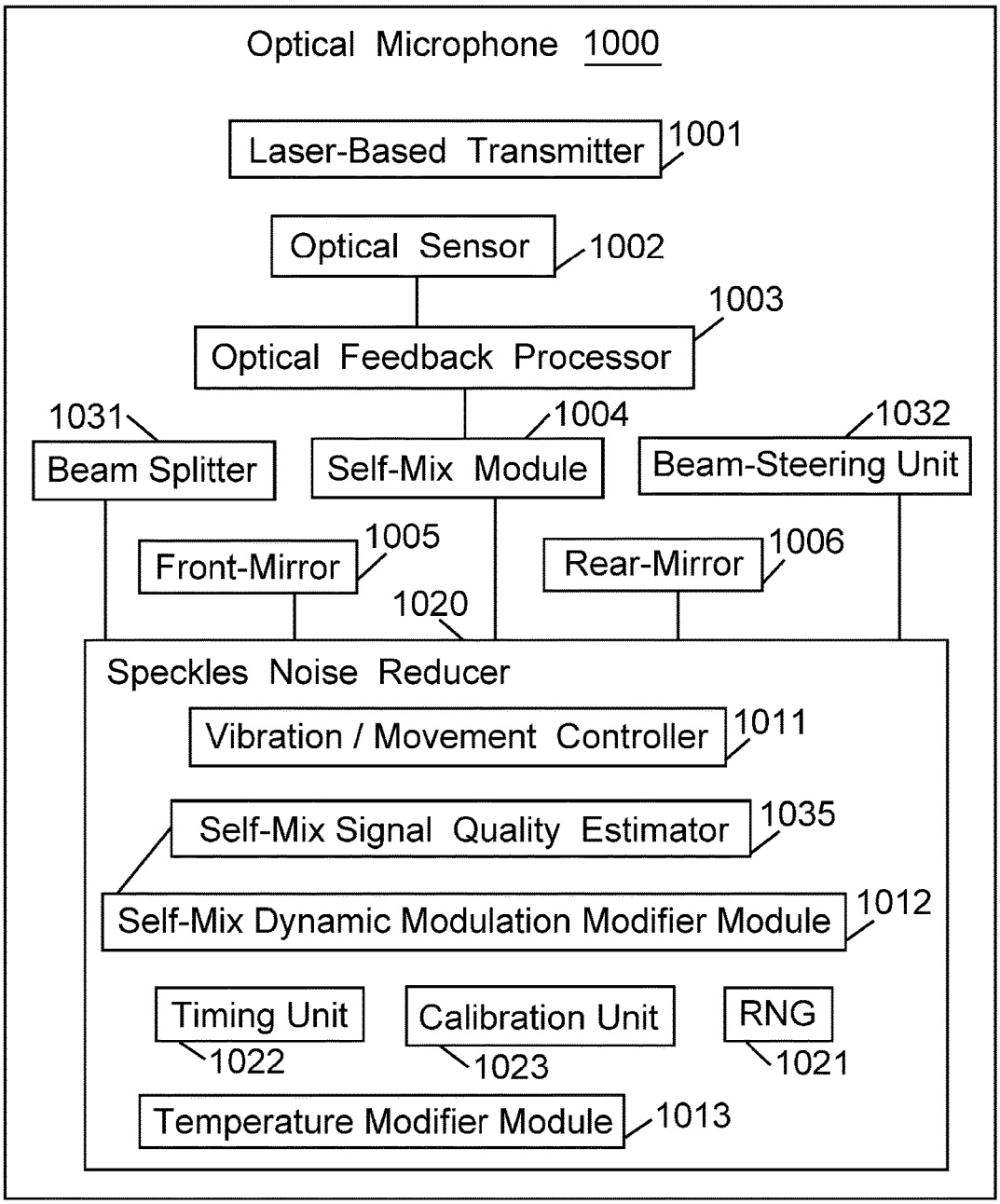
FIG. 3 which is a block-diagram illustration of an optical microphone, in accordance with some demonstrative embodiments of the present invention.

Reference is made to FIG. 3, which is a schematic block-diagram illustration of an optical microphone 1000 (or laser-based microphone, or laser microphone) utilizing a Speckles Noise Reducer 1020, in accordance with some demonstrative embodiments of the present invention. Optical microphone 1000 may comprise, for example, a laser-based transmitter 1001 able to generate and/or transmit a laser beam towards an area-of-interest; an optical sensor 1002 able to capture optical feedback received or reflected from that area-of-interest; and an optical feedback processor 1003 able to process the captured optical feedback, taking into account also information about the transmitted laser beam(s) and their timing.

In some embodiments, the optical microphone 1001 and/or its components may be implemented as (or may comprise) a Self-Mix module 1004 (e.g., the self-mix module 1004 may incorporate therein, or may comprise, or may integrally include, components 1001 and/or 1002 and/or 1003 described above); for example, utilizing a self-mixing interferometry measurement technique (or feedback interferometry, or induced-modulation interferometry, or back-scatter modulation interferometry), in which a laser beam is reflected from an object, back into the laser. The reflected light interferes with the light generated inside the laser, and this causes changes in the optical and/or electrical properties of the laser. Information about the target object and the laser itself may be obtained by analyzing these changes in behavior or properties.

For example, the self-mix module 1004 may comprise a semiconductor laser with front-mirror 1005 (or front-side mirror) and a rear-mirror 1006 (or rear-side mirror). For example, the front-mirror 1005 may be located closer to the target or the area-of-interest, relative to the rear-mirror 1006. Other optical elements or optics elements may be used; for example, a lens, a set of lenses, lens arrangements, beam splitter(s), curved mirror(s), planar mirror(s), side mirror(s), front mirror(s), rear mirror(s), prism(s), beam focusing units, beam spreading units, beam steering units, concave mirror(s), convex mirror(s), and/or other suitable optics elements. For example, a beam-splitter 1031 may split one or more laser beam(s); a beam-steering unit 1032 may steer one or more laser beam(s); and/or other suitable components may be used.

In some embodiments, one or more of such optics elements or components, such as a mirror and/or a beam splitter and/or a beam-steering unit, may optionally be implemented as (or by using) a Micro-Electro-Mechanical Systems (MEMS) device or MEMS component; which may optionally enable such MEMS component to move and/or vibrate and/or be displaced, based on a pre-defined movement pattern and/or timing scheme and/or based on pre-defined conditions.

Some embodiments of the present invention may reduce speckles, or may reduce speckle pattern, or speckle-related noise, of a laser-based microphone system; by utilizing one or more methods for dynamic modulation (using DC, or using AC, or using AC and DC), multi-pattern modulation, mirror-control, and/or other speckle-reduction methods as described herein.

Applicants have realized that in some laser-based microphone systems, speckle patterns may occur (e.g., an intensity pattern produced by mutual interference of a set of wavefronts resulting from a coherent light reflected off rough surface); thereby introducing noise ("speckle noise" or "speckles noise") in the captured optical feedback, or thereby reducing some information from being captured by the optical sensor 1002.

In some embodiments, a vibration/movement controller 1011 may be utilized as part of the optical microphone 1000, or externally (e.g., in proximity to) the optical microphone 1000); in order to introduce random or pseudo-random movements or vibrations to one or more of the mirror(s) of the laser transmitter, such as, to a MEMS mirror or to a MEMS beam splitter or to a MEMS beam steering unit. As a result, the speckles pattern may randomly shift or move, such that a particular point in the area-of-interest may be black (due to a local distractive interference) at a first time-point but may be illuminated (due to a local constrictive interference) at an immediately-subsequent time-point (e.g., 1 or 2 or 5 milliseconds subsequently), due to the shaking or vibrating or movement or displacement of the mirror(s). This, in turn, may enable the optical sensor 1002 to collect or capture optical feedback from that point in the area-of-interest, a point that would be dark or non-laser-illuminated without such intentional vibration or shaking or movement of the laser mirror(s) and/or beam splitter and/or beam steering unit. Over time, even over a time-period of one second or half-a-second or a millisecond or several milliseconds, the speckle pattern may "move", such that each point in the area-of-interest would be non-speckled for at least a small period of time that may thus enable the optical sensor 1002 to collect optical feedback from such point(s) (e.g., using integration of information over time).

In some embodiments, the movement or displacement to the mirror(s) and/or beam splitter and/or beam steering unit, or to the other optics elements or MEMS optics element(s), may be a non-vibrating movement or a non-vibrating displacement; and rather, may be a movement in accordance with a pre-defined pattern or vector(s) or direction(s); for example, moving the mirror(s) or the optics element(s) in a circular course or route, or an oval or elliptic course or route, or in a polygon course or route (e.g., triangle or square or rectangle); or in other suitable movement pattern. Optionally, a calibration process may be used, in order to test multiple such movement routes or displacement routes, and in order to select and to further apply a particular movement pattern or movement route that produces the self-mixed signal having the maximum usefulness or bandwidth, or the least speckles noise.

It is noted that the vibration/movement controller 1011 may be utilized not necessarily for moving or shaking or displacing or vibrating mirror(s) or beam splitter(s) or beam steering unit(s) of the optical microphone; but rather, alternatively or additionally, for moving or shaking or displacing or shaking one or more other optical elements or optics elements which may be used; for example, a lens, a set of lenses, lens arrangements, beam splitter(s), curved mirror(s), planar mirror(s), side mirror(s), front mirror(s), rear mirror(s), prism(s), beam focusing units, beam spreading units, beam steering unit(s), MEMS or MEMS-based optics element(s), concave mirror(s), convex mirror(s), and/or other suitable optics elements. Accordingly, the movement or vibration or shaking or displacement of mirror(s) or beam splitter(s) or beam steering unit(s) is only a non-limiting example of the present invention.

The vibration/movement controller 1011 may optionally operate in a selective manner, to selectively cause only the controlled optics element(s) (or, only the controlled MEMS optics elements) to vibrate or to move; while other components, or while all the other components, of the optical microphone or the system, are maintained non-vibrating and/or non-moving. Additionally or alternatively, such "selective" operation of the vibration/movement controller 1011 may optionally include, for example, activation of such vibration or movement in particular time-slots, and de-activation of such vibration or movement in particular other time-slots; such that not at all time is the controlled element being vibrated or being moved. The selective operation, or activation/deactivation, may be in accordance with a pre-defined timing scheme; or random or pseudo-random; or based on a pre-defined movement pattern or movement course, or displacement pattern or displacement course; or based on a particular scheme that is selected by a calibrator unit after trying two or more such schemes (e.g., based on the greater or the greatest advantage achieved, or the greater or greatest bandwidth of the self-mixed signal achieved).

In some embodiments, a Self-Mix Dynamic Modulation Modifier Module (SDMMM) 1012 may be utilized as part of the optical microphone 1000; in order to introduce random or pseudo-random modifications, or pre-defined patterned modifications, to the modulation used by the Self-Mix module; thereby causing or triggering a slight modification of the temperature of self-mix module, thereby causing or triggering a slight yet functionally-important modification of the wavelength of the transmitted laser beam or modifying the beam angular spread, and thereby reducing or eliminating the speckle pattern, or causing the speckle pattern to move-around in a manner that allows the optical sensor 1002 to collect optical feedback from all points or from additional points of the area-of-interest (e.g., from points that would have been "black" or dark or non-illuminated without such modulation modification).

In some embodiments, the SDMMM 1012 may operate in conjunction with, or by utilizing, a temperature modifier module 1013 which may directly or indirectly modify or affect the temperature or the operating temperature of the Self-Mix module or chamber and/or of the laser transmitter and/or of the laser modulator. For example, the temperature modifier module 1013 may increase or decrease the electric power or voltage or electric current that is provided to the Self-Mix module and/or to other components of the system, and/or may otherwise change electrical resistance of one or more circuits or components (e.g., operating as rheostat), in order to indirectly cause the change of temperature which thus affects the wavelength of the transmitted laser beam.

In some embodiments, the SDMMM 1012 optionally operate in a selective manner, to selectively cause modulation modification(s) only in at a particular time, or at particular time point(s) or time intervals or time slots, or only when a pre-defined condition or a triggering condition holds true or is observed or is determined to exist, and/or only as long as such condition holds true to continues to exist; or in accordance with a timing scheme, or a pseudo-random scheme, or other suitable timing scheme, regulation scheme, and/or operation scheme.

In some embodiments, optionally, a Self-Mix Signal Quality Estimator 1035 may estimate or measure or determine one or more quality indicator(s) or quality score(s) of the self-mix signal; and optionally, may compare the determined quality indicator (e.g., bandwidth, efficiency, usefulness, or the like) of the self-mix signal to one or more threshold values or to a pre-defined range of values, or to minimum or maximum values, in order to determine whether the current or recent or actual quality of the self-mix signal is sufficient for one or more particular purposes (e.g., for speech recognition purposes; for blind source separation purposes; for voice detection purposes; or the like). In some embodiments, if the Self-Mix Signal Quality Estimator 1035 determines that the quality (e.g., bandwidth, magnitude) of the self-mix signal is sufficient, then the Self-Mix Signal Quality Estimator 1035 may generate a signal or a command indicating that one or more speckles noise reduction mechanisms (e.g., modulation modification; vibration or displacement of optics elements) need not be operational, or can be de-activated or paused. Conversely, if the Self-Mix Signal Quality Estimator 1035 determines that the quality (e.g., bandwidth) of the self-mix signal is insufficient (e.g., is below a pre-defined threshold value), then the Self-Mix Signal Quality Estimator 1035 may generate a signal or a command indicating that one or more speckles noise reduction mechanisms (e.g., modulation modification; vibration or displacement of optics elements) are required to become operational, or are to be de-activated or resumed or applied. In some embodiments, for example, such speckles noise reduction mechanisms may be dormant or non-activated as a default operational status; and may be activated only if the quality or efficiency or usefulness or magnitude or bandwidth of the self-mix signal drops to be lower than a threshold value, or external to a suitable range of values. In some embodiments, such activation or deactivation of the speckles noise reduction, may be performed based on a command or a signal generated by the Self-Mix Signal Quality Estimator 1035, or based on another component of the optical microphone (e.g., a separate unit or module, such as a speckles noise reduction activation/deactivation module or unit.)

Optionally, a Random Number Generator (RNG) 1021 or a Pseudo-Random Number Generator (PRNG) may be utilized, or may be comprised in the system or may be otherwise associated with the system or may be accessed by the system, in order to provide random or pseudo-random triggering signals for causing random or pseudo-random movements or vibrations or temperature-change or modulation change.

Optionally, a Timing Unit 1022, which may be associated with or may comprise or may utilize a Real Time Clock (RTC) or other counter, may generate a timing scheme or timing pattern or timing schedule that may be utilized for the temperature modifications and/or the modulation modifications and/or the mirror displacement (or mirror movement, or mirror vibrations); and such other units may follow or may operate in accordance with the generated timing scheme, to ensure that speckle noise is reduced.

Optionally, the Timing Unit may comprise (or may be associated with) a calibration module 1023 or a self-calibration module; which may generate and try several timing schemes, may measure or may estimate the bandwidth (or the usefulness) of the reflected optical signal or of the self-mixed signal, and may then select the timing scheme which contributes to the highest bandwidth or highest efficiency.

Accordingly, the Speckles Noise Reducer 1020 may comprise the components as depicted in FIG. 3, and/or may comprise (and/or may utilize) other suitable units or components in order to achieve the result of eliminating or reducing speckles noise, or otherwise increasing the bandwidth (or usefulness) of the reflected optical signal and/or the self-mixed signal.

The terms "laser" or "laser transmitter" as used herein may comprise or may be, for example, a stand-alone laser transmitter, a laser transmitter unit, a laser generator, a component able to generate and/or transmit a laser beam or a laser ray, a laser drive, a laser driver, a laser transmitter associated with a modulator, a combination of laser transmitter with modulator, a combination of laser driver or laser drive with modulator, or other suitable component able to generate and/or transmit a laser beam.

The term "acoustic microphone" as used herein, may comprise one or more acoustic microphone(s) and/or acoustic sensor(s); or a matrix or array or set or group or batch or arrangement of multiple such acoustic microphones and/or acoustic sensors; or one or more sensors or devices or units or transducers or converters (e.g., an acoustic-to-electric transducer or converter) able to convert sound into an electrical signal; a microphone or transducer that utilizes electromagnetic induction (e.g., a dynamic microphone) and/or capacitance change (e.g., a condenser microphone) and/or piezoelectricity (e.g., a piezoelectric microphones) in order to produce an electrical signal from air pressure variations; a microphone that may optionally be connected to, or may be associated with or may comprise also, a pre-amplifier or an amplifier; a carbon microphone; a carbon button microphone; a button microphone; a ribbon microphone; an electret condenser microphone; a capacitor microphone; a magneto-dynamic microphone; a dynamic microphone; an electrostatic microphone; a Radio Frequency (RF) condenser microphone; a crystal microphone; a piezo microphone or piezoelectric microphone; and/or other suitable types of audio microphones, acoustic microphones and/or sound-capturing microphones.

The term "laser microphone" as used herein, may comprise, for example: one or more laser microphone(s) or sensor(s); one or more laser-based microphone(s) or sensor(s); one or more optical microphone(s) or sensor(s); one or more microphone(s) or sensor(s) that utilize coherent electromagnetic waves; one or more optical sensor(s) or laser-based sensor(s) that utilize vibrometry, or that comprise or utilize a vibrometer; one or more optical sensor(s) and/or laser-based sensor(s) that comprise a self-mix module, or that utilize self-mixing interferometry measurement technique (or feedback interferometry, or induced-modulation interferometry, or backscatter modulation interferometry), in which a laser beam is reflected from an object, back into the laser, and the reflected light interferes with the light generated inside the laser, and this causes changes in the optical and/or electrical properties of the laser, and information about the target object and the laser itself may be obtained by analyzing these changes.

The terms "vibrating" or "vibrations" or "vibrate" or similar terms, as used herein, refer and include also any other suitable type of motion, and may not necessarily require vibration or resonance per se; and may include, for example, any suitable type of motion, movement, shifting, drifting, slanting, horizontal movement, vertical movement, diagonal movement, one-dimensional movement, two-dimensional movement, three-dimensional movement, or the like.

In some embodiments of the present invention, which may optionally utilize a laser microphone, only "safe" laser beams or sources may be used; for example, laser beam(s) or source(s) that are known to be non-damaging to human body and/or to human eyes, or laser beam(s) or source(s) that are known to be non-damaging even if accidently hitting human eyes for a short period of time. Some embodiments may utilize, for example, Eye-Safe laser, infra-red laser, infra-red optical signal(s), low-strength laser, and/or other suitable type(s) of optical signals, optical beam(s), laser beam(s), infra-red beam(s), or the like. It would be appreciated by persons of ordinary skill in the art, that one or more suitable types of laser beam(s) or laser source(s) may be selected and utilized, in order to safely and efficiently implement the system and method of the present invention. In some embodiments, optionally, a human speaker or a human user may be requested to wear sunglasses or protective eye-gear or protective goggles, in order to provide additional safety to the eyes of the human user which may occasionally be "hit" by such generally-safe laser beam, as an additional precaution.

In some embodiments which may utilize a laser microphone or optical microphone, such optical microphone (or optical sensor) and/or its components may be implemented as (or may comprise) a Self-Mix module; for example, utilizing a self-mixing interferometry measurement technique (or feedback interferometry, or induced-modulation interferometry, or backscatter modulation interferometry), in which a laser beam is reflected from an object, back into the laser. The reflected light interferes with the light generated inside the laser, and this causes changes in the optical and/or electrical properties of the laser. Information about the target object and the laser itself may be obtained by analyzing these changes. In some embodiments, the optical microphone or laser microphone operates to remotely detect or measure or estimate vibrations of the skin (or the surface) of a face-point or a face-region or a face-area of the human speaker (e.g., mouth, mouth-area, lips, lips-area, cheek, nose, chin, neck, throat, ear); and/or to remotely detect or measure or estimate the direct changes in skin vibrations; rather than trying to measure indirectly an effect of spoken speech on a vapor that is exhaled by the mouth of the speaker, and rather than trying to measure indirectly an effect of spoken speech on the humidity or relative humidity or gas components or liquid components that may be produced by the mouth due to spoken speech.

The present invention may be utilized in, or with, or in conjunction with, a variety of devices or systems that may benefit from noise reduction and/or speech enhancement; for example, a smartphone, a cellular phone, a cordless phone, a video conference system or device, a tele-conference system or device, an audio/video camera, a web-camera or web-cam, a landline telephony system, a cellular telephone system, a voice-messaging system, a Voice-over-IP system or network or device, a vehicle, a vehicular dashboard, a vehicular audio system or microphone, a navigation device or system, a vehicular navigation device or system, a mapping or route-guidance device or system, a vehicular route-guidance or device or system, a dictation system or device, Speech Recognition (SR) device or module or system, Automatic Speech Recognition (ASR) module or device or system, a speech-to-text converter or conversion system or device, a laptop computer, a desktop computer, a notebook computer, a tablet, a phone-tablet or "phablet" device, a gaming device, a gaming console, a wearable device, a smart-watch, a Virtual Reality (VR) device or helmet or glasses or headgear, an Augmented Reality (AR) device or helmet or glasses or headgear, an Internet of Things (IoT) device or appliance, an Internet-connected device or appliance, a wireless-connected device or appliance, a device or system or module that utilizes speech-based commands or audio commands, a device or system that captures and/or records and/or processes and/or analyzes audio signals and/or speech and/or acoustic signals, and/or other suitable systems and devices.

Some embodiments of the present invention may provide or may comprise a laser-based device or apparatus or system, a laser-based microphone or sensor, a laser microphone or sensor, an optical microphone or sensor, a hybrid acoustic-optical sensor or microphone, a combined acoustic-optical sensor or microphone, and/or a system that comprises or utilizes one or more of the above.

Figure 4:
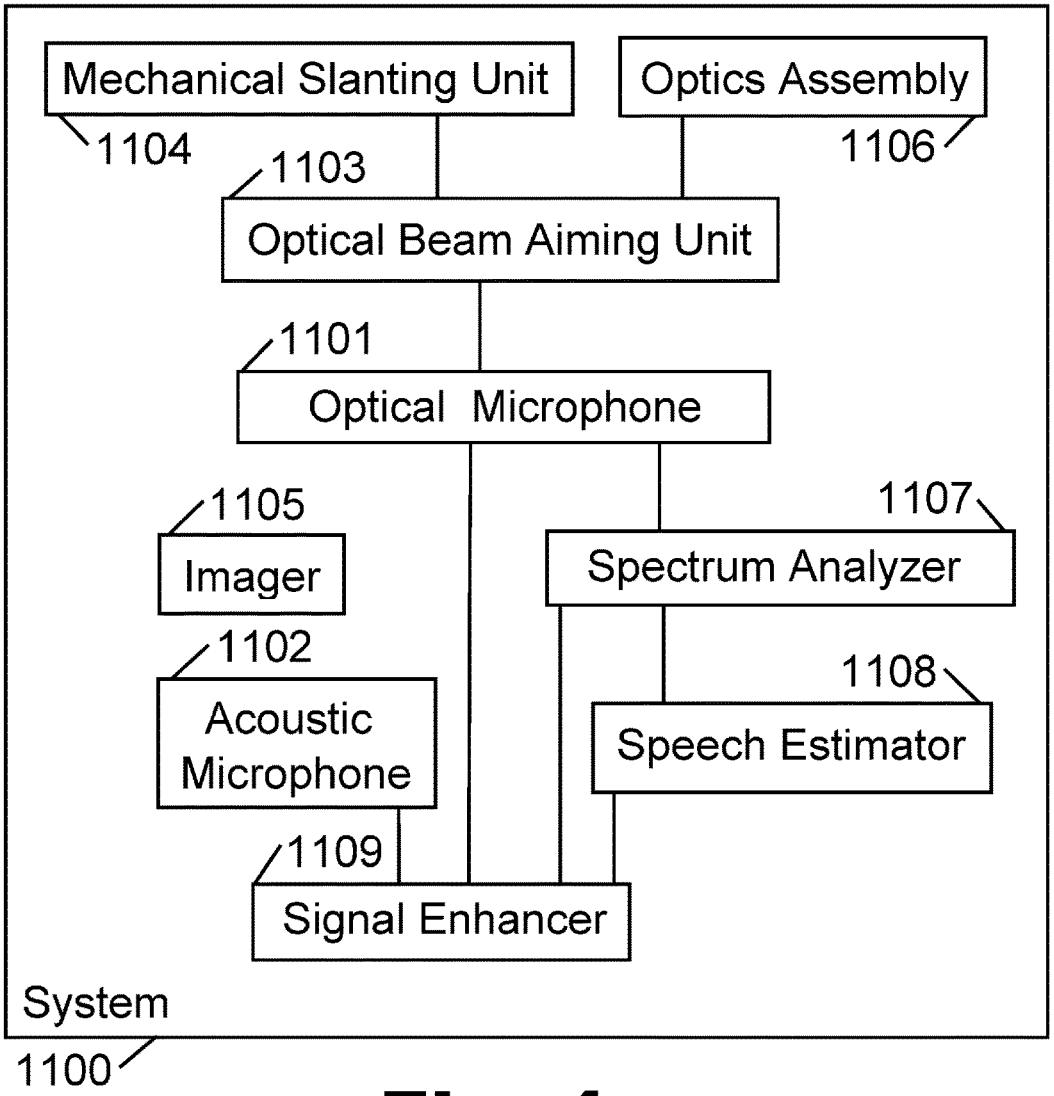
FIG. 4 is a block-diagram illustration of a hybrid system, in accordance with some demonstrative embodiments of the present invention.

Reference is made to FIG. 4, which is a schematic block-diagram illustration of a system 1100, in accordance with some demonstrative embodiments of the present invention.

System 1100 may comprise, for example, an optical microphone 1101 able to transmit an optical beam (e.g., a laser beam) towards a target (e.g., a face of a human speaker), and able to capture and analyze the optical feedback that is reflected from the target, particularly from vibrating regions or vibrating face-regions or face-portions of the human speaker. The optical microphone 1101 may be or may comprise or may utilize a Self-Mix (SM) chamber or unit, an interferometry chamber or unit, an interferometer, a vibrometer, a targeted vibrometer, or other suitable component, able to analyze the spectrum of the received optical signal with reference to the transmitted optical beam, and able to remotely estimate the audio or speech or utterances generated by the target (e.g., the human speaker).

Optionally, system 1100 may comprise an acoustic microphone 1102 or an audio microphone, which may capture audio. Optionally, the analysis results of the optical feedback may be utilized in order to improve or enhance or filter the captured audio signal; and/or to reduce or cancel noise(s)

from the captured audio signal. Optionally, system 1100 may be implemented as a hybrid acoustic-and-optical sensor, or as a hybrid acoustic-and-optical sensor. In other embodiments, system 1100 need not necessarily comprise an acoustic microphone. In yet other embodiments, system 1100 may comprise optical microphone 1102 and may not comprise any acoustic microphones, but may operate in conjunction with an external or a remote acoustic microphone.

System 1100 may further comprise an optical beam aiming unit 1103 (or tilting unit, or slanting unit, or positioning unit, or targeting unit, or directing unit), for example, implemented as a laser beam directing unit or aiming unit or other unit or module able to direct a transmitted optical beam (e.g., a transmitted laser beam) towards the target, and/or able to fine-tune or modify the direction of such optical beam or laser beam. The directing or alignment of the optical beam or laser beam, towards the target, may be performed or achieved by using one or more suitable mechanisms.

In a first example, the optical microphone 1101 may be fixedly mounted or attached or located at a first location or point (e.g., on a vehicular dashboard; on a frame of a screen of a laptop computer), and may generally point or be directed towards an estimated location or a general location of a human speaker that typically utilizes such device (e.g., aiming or targeting an estimated general location of a head of a driver in a vehicle; or aiming or targeting an estimated general location of a head of a laptop computer user); based on a fixed or pre-mounted angular slanting or positioning (e.g., performed by a maker of the vehicular dashboard or vehicle, or by the maker of the laptop computer).

In a second example, the optical microphone may be mounted on a wall of a lecture hall; and may be fixedly pointing or aiming its laser beam or its optical beam towards a general location of a stage or a podium in that lecture hall, in order to target a human speaker who is a lecturer.

In a third example, a motor or engine or robotic arm or other mechanical slanting unit 1104 may be used, in order to align or slant or tilt the direction of the optical beam or laser beam of the optical microphone, towards an actual or an estimated location of a human speaker; optionally via a control interface that allows an administrator to command the movement or the slanting of the optical microphone towards a desired target (e.g., similar to the manner in which an optical camera or an imager or a video-recording device may be moved or tilted via a control interface, a pan-tilt-zoom (PTZ) interface, a robotic arm, or the like).

In a fourth example, an imager 1105 or camera may be used in order to capture images or video of the surrounding of the optical microphone; and a face-recognition module or image-recognition module or a face-identifying module or other Computer Vision algorithm or module may be used in order to analyze the captured images or video and to determine the location of a human speaker (or a particular, desired, human speaker), and to cause the slanting or aiming or targeting or re-aligning of the optical beam to aim towards the identified human speaker. In a fifth example, a human speaker may be requested to wear or to carry a particular tag or token or article or object, having a pre-defined shape or color or pattern which is not typically found at random (e.g., tag or a button showing a green triangle within a yellow square); and an imager or camera may scan an area or a surrounding of system 1100, may analyze the images or video to detect or to find the pre-defined tag, and may aim the optical microphone towards the tag, or towards a pre-defined or estimated offset distance from that tag (e.g., a predefined K degrees of slanting upwardly or vertically relative to the detected tag, if the human speaker is instructed to carry the tag or to wear the tag on his jacket pocket).

In a sixth example, an optics assembly 1106 or optics arrangement (e.g., one or more mirrors, flat mirrors, concave mirrors, convex mirrors, lenses, prisms, beam-splitters, focusing elements, diffracting elements, diffractive elements, condensing elements, and/or other optics elements or optical elements) may be utilized in order to direct or aim the optical beam or laser beam towards a known or estimated or general location of a target or a speaker or a human face. The optics assembly may be fixedly mounted in advance (e.g., within a vehicle, in order to aim or target a vehicular optical sensor towards a general-location of a driver face), or may be dynamically adjusted or moved or tilted or slanted based on real-time information regarding the actual or estimated location of the speaker or his head (e.g., determined by using an imager, or determined by finding a Signal to Noise Ratio (SNR) value that is greater than a threshold value).

In a seventh example, the optical microphone may move or may "scan" a target area (e.g., by being moved or slanted via the mechanical slanting unit 1104); and may remain at, or may go-back to, a particular direction in which the Signal to Noise Ratio (SNR) value was the maximal, or optimal, or greater than a threshold value.

In an eighth example, particularly if the human speaker is moving on a stage or moving in a room, or moves his face to different directions, the human speaker may be requested or required to stand at a particular spot or location in order to enable the system to efficiently work (e.g., similarly to the manner in which a singer or a performer is required to stand in proximity to a wired acoustic microphone which is mounted on a microphone stand); and/or the human speaker may be requested or required to look to a particular direction or to move his face to a particular direction (e.g., to look directly towards the optical microphone) in order for the system to efficiently operate (e.g., similar to the manner in which a singer or a performer may be requested to look at a camera or a video-recorder, or to put his mouth in close proximity to an acoustic microphone that he holds).

Other suitable mechanisms may be used to achieve or to fine-tune aiming, targeting and/or aligning of the optical beam with the desired target.

It is clarified that the optical microphone and/or the system of the present invention, need not be continuously aligned with the target or the human speaker, and need not necessarily "hit" the speaker continuously with laser beam or optical beam. Rather, in some embodiments, the present invention may operate only during time-periods in which the optical beam or laser beam actually "hits" the face of the speaker, or actually causes reflection of optical feedback from vibrating face-regions of the human speaker. In some embodiments, the system may operate or may efficiently operate at least during time period(s) in which the laser beam(s) or the optical signal(s) actually hit (or reach, or touch) the face or the mouth or the mouth-region of a speaker; and not in other time-periods or time-slots. In some embodiments, the system and/or method need not necessarily provide continuous speech enhancement or continuous noise reduction or continuous speech detection; but rather, in some embodiments the speech enhancement and/or noise reduction and/or speech detection may be achieved in those specific time-periods in which the laser beam(s) actually hit the face of the speaker and cause a reflection of optical feedback from vibrating surfaces or face-regions. In some embodiments, the system may operate only during such time periods (e.g., only a few minutes out of an hour; or only a few seconds out of a minute) in which such actual "hit" of the laser beam with the face-region is achieved. In other embodiments, continuous or substantially-continuous noise reduction and/or speech enhancement may be achieved; for example, in a vehicular system in which the laser beam is directed towards the location of the head or the face of the driver.

In accordance with the present invention, the optical microphone 1101 may comprise a self-mix chamber or unit or self-mix interferometer or a targeted vibrometer, and may utilize reflected optical feedback (e.g., reflected feedback of a transmitted laser beam) in order to remotely measure or estimate vibrations of the facial skin or facial-regions head-regions of a human speaker, utilizing a spectrum analyzer 1107 in order to analyze the optical feedback with reference to the transmitted optical feedback, and utilizing a speech estimator unit 1108 to estimate or extract a signal that corresponds to speech or audio that is generated or uttered by that human speaker.

Optionally, system 1100 may comprise a signal enhancer 1109, which may enhance, filter, improve and/or clean the acoustic signal that is captured by acoustic microphone 1102, based on output generated by the optical microphone 1101. For example, system 1100 may dynamically generate and may dynamically apply, to the acoustic signal captured by the acoustic microphone 1102, a digital filter which may be dynamically constructed by taking into account the output of the optical microphone 1101, and/or by taking into account an analysis of the optical feedback or optical signal(s) that are reflected back from the face of the human speaker.

System 1100 may further comprise any, or some, or all, of the components and/or systems that are depicted in any of FIGS. 1-3, and/or that are discussed with reference to FIGS. 1-3 and/or above and/or herein.

The present invention may be utilized in conjunction with one or more types of acoustic samples or data samples, or a voice sample or voice print, which may not necessarily be merely an acoustic recording or raw acoustic sounds, and/or which may not necessarily be a cleaned or digitally-cleaned or filtered or digitally-filtered acoustic recording or acoustic data. For example, the present invention may utilize, or may operate in conjunction with, in addition to or instead of the other samples or data as described above, one or more of the following: (a) the speech signal, or estimated or detected speech signal, as determined by the optical microphone 1101 based on an analysis of the self-mixed optical signals; (b) an acoustic sample as captured by the acoustic microphone 1102, by itself and/or in combination with the speech signal estimated by the optical microphone 1101; (c) an acoustic sample as captured by the acoustic microphone 1102 and as cleaned or digitally-cleaned or filtered or digitally-filtered or otherwise digitally-adjusted or digitally-modified based on the speech signal estimated by the optical microphone 1101; (d) a voice print or speech sample which is acquired and/or produced by utilizing one or more biometric algorithms or sub-modules, such as a Neural Network module or a Hidden Markov Model (HMM) unit, which may utilize both the acoustic signal and the optical signal (e.g., the self-mixed signals of the optical microphone 1101) in order to extract more data and/or more user-specific characteristics from utterances of the human speaker.

Some embodiments of the present invention may comprise an optical microphone or laser microphone or a laser-based microphone, or optical sensor or laser sensor or laser-based sensor, which utilizes multiple lasers or multiple laser beams or multiple laser transmitters, in conjunction with a single laser drive component and/or a single laser receiver component, thereby increasing or improving the efficiency of self-mix techniques or module or chamber (or self-mix interferometry techniques or module or chamber) utilized by such optical or laser-based microphone or sensor.

In some embodiments of the present invention, which may optionally utilize a laser microphone or optical microphone, the laser beam or optical beam may be directed to an estimated general-location of the speaker; or to a pre-defined target area or target region in which a speaker may be located, or in which a speaker is estimated to be located. For example, the laser source may be placed inside a vehicle, and may be targeting the general location at which a head of the driver is typically located. In other embodiments, a system may optionally comprise one or more modules that may, for example, locate or find or detect or track, a face or a mouth or a head of a person (or of a speaker), for example, based on image recognition, based on video analysis or image analysis, based on a pre-defined item or object (e.g., the speaker may wear a particular item, such as a hat or a collar having a particular shape and/or color and/or characteristics), or the like. In some embodiments, the laser source(s) may be static or fixed, and may fixedly point towards a general-location or towards an estimated-location of a speaker. In other embodiments, the laser source(s) may be non-fixed, or may be able to automatically move and/or change their orientation, for example, to track or to aim towards a general-location or an estimated-location or a precise-location of a speaker. In some embodiments, multiple laser source(s) may be used in parallel, and they may be fixed and/or moving.

In some demonstrative embodiments of the present invention, which may optionally utilize a laser microphone or optical microphone, the system and method may efficiently operate at least during time period(s) in which the laser beam(s) or the optical signal(s) actually hit (or reach, or touch) the face or the mouth or the mouth-region of a speaker. In some embodiments, the system and/or method need not necessarily provide continuous speech enhancement or continuous noise reduction; but rather, in some embodiments the speech enhancement and/or noise reduction may be achieved in those time-periods in which the laser beam(s) actually hit the face of the speaker. In other embodiments, continuous or substantially-continuous noise reduction and/or speech enhancement may be achieved; for example, in a vehicular system in which the laser beam is directed towards the location of the head or the face of the driver.

The system(s) of the present invention may optionally comprise, or may be implemented by utilizing suitable hardware components and/or software components; for example, processors, processor cores, Central Processing Units (CPUs), Digital Signal Processors (DSPs), circuits, Integrated Circuits (ICs), controllers, memory units, registers, accumulators, storage units, input units (e.g., touch-screen, keyboard, keypad, stylus, mouse, touchpad, joystick, trackball, microphones), output units (e.g., screen, touch-screen, monitor, display unit, audio speakers), acoustic microphone(s) and/or sensor(s), optical microphone(s) and/or sensor(s), laser or laser-based microphone(s) and/or sensor(s), wired or wireless modems or transceivers or transmitters or receivers, GPS receiver or GPS element or other location-based or location-determining unit or system, network elements (e.g., routers, switches, hubs, antennas), and/or other suitable components and/or modules. The system(s) of the present invention may optionally be implemented by utilizing co-located components, remote components or modules, "cloud computing" servers or devices or storage, client/server architecture, peer-to-peer architecture, distributed architecture, and/or other suitable architectures or system topologies or network topologies.

Some embodiments of the present invention may comprise, or may utilize, or may be utilized in conjunction with, one or more elements, units, devices, systems and/or methods that are described in U.S. Pat. No. 7,775,113, titled "Sound sources separation and monitoring using directional coherent electromagnetic waves", which is hereby incorporated by reference in its entirety.

Some embodiments of the present invention may comprise, or may utilize, or may be utilized in conjunction with, one or more elements, units, devices, systems and/or methods that are described in U.S. Pat. No. 8,286,493, titled "Sound sources separation and monitoring using directional coherent electromagnetic waves", which is hereby incorporated by reference in its entirety.

Some embodiments of the present invention may comprise, or may utilize, or may be utilized in conjunction with, one or more elements, units, devices, systems and/or methods that are described in U.S. Pat. No. 8,949,118, titled "System and method for robust estimation and tracking the fundamental frequency of pseudo periodic signals in the presence of noise", which is hereby incorporated by reference in its entirety.

Some embodiments of the present invention may comprise, or may utilize, or may be utilized in conjunction with, one or more elements, units, devices, systems and/or methods that are described in U.S. Pat. No. 9,344,811, titled "System and method for detection of speech related acoustic signals by using a laser microphone", which is hereby incorporated by reference in its entirety.

In accordance with embodiments of the present invention, calculations, operations and/or determinations may be performed locally within a single device, or may be performed by or across multiple devices, or may be performed partially locally and partially remotely (e.g., at a remote server) by optionally utilizing a communication channel to exchange raw data and/or processed data and/or processing results.

Although portions of the discussion herein relate, for demonstrative purposes, to wired links and/or wired communications, some embodiments are not limited in this regard, but rather, may utilize wired communication and/or wireless communication; may include one or more wired and/or wireless links; may utilize one or more components of wired communication and/or wireless communication; and/or may utilize one or more methods or protocols or standards of wireless communication.

Some embodiments may be implemented by using a special-purpose machine or a specific-purpose device that is not a generic computer, or by using a non-generic computer or a non-general computer or machine. Such system or device may utilize or may comprise one or more components or units or modules that are not part of a "generic computer" and that are not part of a "general purpose computer", for example, cellular transceivers, cellular transmitter, cellular receiver, GPS unit, location-determining unit, accelerometer(s), gyroscope(s), device-orientation detectors or sensors, device-positioning detectors or sensors, or the like.

Some embodiments may be implemented as, or by utilizing, an automated method or automated process, or a machine-implemented method or process, or as a semi-automated or partially-automated method or process, or as a set of steps or operations which may be executed or performed by a computer or machine or system or other device.

Some embodiments may be implemented by using code or program code or machine-readable instructions or machine-readable code, which may be stored on a non-transitory storage medium or non-transitory storage article (e.g., a CD-ROM, a DVD-ROM, a physical memory unit, a physical storage unit), such that the program or code or instructions, when executed by a processor or a machine or a computer, cause such processor or machine or computer to perform a method or process as described herein. Such code or instructions may be or may comprise, for example, one or more of: software, a software module, an application, a program, a subroutine, instructions, an instruction set, computing code, words, values, symbols, strings, variables, source code, compiled code, interpreted code, executable code, static code, dynamic code; including (but not limited to) code or instructions in high-level programming language, low-level programming language, object-oriented programming language, visual programming language, compiled programming language, interpreted programming language, C, C++, C#, Java, JavaScript, SQL, Ruby on Rails, Go, Cobol, Fortran, ActionScript, AJAX, XML, JSON, Lisp, Eiffel, Verilog, Hardware Description Language (HDL, BASIC, Visual BASIC, Matlab, Pascal, HTML, HTML5, CSS, Perl, Python, PHP, machine language, machine code, assembly language, or the like.

Discussions herein utilizing terms such as, for example, "processing", "computing", "calculating", "determining", "establishing", "analyzing", "checking", "detecting", "measuring", or the like, may refer to operation(s) and/or process(es) of a processor, a computer, a computing platform, a computing system, or other electronic device or computing device, that may automatically and/or autonomously manipulate and/or transform data represented as physical (e.g., electronic) quantities within registers and/or accumulators and/or memory units and/or storage units into other data or that may perform other suitable operations.

The terms "plurality" and "a plurality", as used herein, include, for example, "multiple" or "two or more". For example, "a plurality of items" includes two or more items.

References to "one embodiment", "an embodiment", "demonstrative embodiment", "various embodiments", "some embodiments", and/or similar terms, may indicate that the embodiment(s) so described may optionally include a particular feature, structure, or characteristic, but not every embodiment necessarily includes the particular feature, structure, or characteristic. Furthermore, repeated use of the phrase "in one embodiment" does not necessarily refer to the same embodiment, although it may. Similarly, repeated use of the phrase "in some embodiments" does not necessarily refer to the same set or group of embodiments, although it may.

As used herein, and unless otherwise specified, the utilization of ordinal adjectives such as "first", "second", "third", "fourth", and so forth, to describe an item or an object, merely indicates that different instances of such like items or objects are being referred to; and does not intend to imply as if the items or objects so described must be in a particular given sequence, either temporally, spatially, in ranking, or in any other ordering manner.

Some embodiments may be used in, or in conjunction with, various devices and systems, for example, a Personal Computer (PC), a desktop computer, a mobile computer, a laptop computer, a notebook computer, a tablet computer, a server computer, a handheld computer, a handheld device, a Personal Digital Assistant (PDA) device, a handheld PDA device, a tablet, an on-board device, an off-board device, a hybrid device, a vehicular device, a non-vehicular device, a mobile or portable device, a consumer device, a non-mobile or non-portable device, an appliance, a wireless communication station, a wireless communication device, a wireless Access Point (AP), a wired or wireless router or gateway or switch or hub, a wired or wireless modem, a video device, an audio device, an audio-video (A/V) device, a wired or wireless network, a wireless area network, a Wireless Video Area Network (WVAN), a Local Area Network (LAN), a Wireless LAN (WLAN), a Personal Area Network (PAN), a Wireless PAN (WPAN), or the like.

Some embodiments may be used in conjunction with one way and/or two-way radio communication systems, cellular radio-telephone communication systems, a mobile phone, a cellular telephone, a wireless telephone, a Personal Communication Systems (PCS) device, a PDA or handheld device which incorporates wireless communication capabilities, a mobile or portable Global Positioning System (GPS) device, a device which incorporates a GPS receiver or transceiver or chip, a device which incorporates an RFID element or chip, a Multiple Input Multiple Output (MIMO) transceiver or device, a Single Input Multiple Output (SIMO) transceiver or device, a Multiple Input Single Output (MISO) transceiver or device, a device having one or more internal antennas and/or external antennas, Digital Video Broadcast (DVB) devices or systems, multi-standard radio devices or systems, a wired or wireless handheld device, e.g., a Smartphone, a Wireless Application Protocol (WAP) device, or the like.

Some embodiments may comprise, or may be implemented by using, an "app" or application which may be downloaded or obtained from an "app store" or "applications store", for free or for a fee, or which may be pre-installed on a computing device or electronic device, or which may be otherwise transported to and/or installed on such computing device or electronic device.

In accordance with some embodiments of the present invention, for example, a system may include a laser microphone comprising: (a) a self-mix interferometry unit, (i) to transmit via a laser transmitter an outgoing laser beam towards a face of the human speaker, and (ii) to receive an optical feedback signal reflected from the face of the human speaker, and (iii) to generate an optical self-mix signal by self-mixing interferometry of the laser power and the received optical feedback signal; (b) a speckles noise reducer to reduce speckles noise and to increase a bandwidth of said optical self-mix signal.

In some embodiments, the system comprises a movable beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable beam-splitter to vibrate, wherein vibrations of said movable beam-splitter reduce speckles noise of said optical self-mix signal.

In some embodiments, the system comprises a movable beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable beam-splitter to vibrate based on a pseudo-random vibration pattern, wherein vibrations of said movable beam-splitter reduce speckles noise of said optical self-mix signal.

In some embodiments, the system comprises a movable beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable beam-splitter to vibrate based on a pre-defined timing scheme, wherein vibrations of said movable beam-splitter reduce speckles noise of said optical self-mix signal.

In some embodiments, the system comprises a movable beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable beam-splitter to vibrate based on a pre-defined timing scheme, wherein vibrations of said movable beam-splitter reduce speckles noise of said optical self-mix signal; wherein the speckles noise reducer further comprises a calibration unit, to check an effect of at least two timing schemes on speckles noise reduction, and to select a particular timing scheme that provides a greater reduction in speckles noise.

In some embodiments, the system comprises a movable beam-splitter that is co-located in proximity to said laser transmitter and to said self-mix interferometry unit, to split one or more laser beams generated by said laser transmitter; wherein the speckles noise reducer comprises a beam-splitter displacement controller to selectively cause said movable beam-splitter to move in a non-vibrating pattern, wherein displacement of said movable beam-splitter reduces speckles noise of said optical self-mix signal.

In some embodiments, the system comprises a movable beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause only said movable beam-splitter to vibrate, wherein other components of the laser microphone are maintained non-vibrating; wherein vibrations of said movable beam-splitter reduce speckles noise of said optical self-mix signal.

In some embodiments, the system comprises a movable Micro-Electro-Mechanical Systems (MEMS) beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable MEMS beam-splitter to vibrate, wherein vibrations of said movable MEMS beam-splitter reduce speckles noise of said optical self-mix signal.

In some embodiments, the system comprises a movable Micro-Electro-Mechanical Systems (MEMS) beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable MEMS beam-splitter to vibrate based on a pseudo-random vibration pattern, wherein vibrations of said movable MEMS beam-splitter reduce speckles noise of said optical self-mix signal.

In some embodiments, the system comprises a movable Micro-Electro-Mechanical Systems (MEMS) beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable MEMS beam-splitter to vibrate based on a pre-defined timing scheme, wherein vibrations of said movable MEMS beam-splitter reduce speckles noise of said optical self-mix signal.

In some embodiments, the system comprises a movable Micro-Electro-Mechanical Systems (MEMS) beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable MEMS beam-splitter to vibrate based on a pre-defined timing scheme, wherein vibrations of said movable MEMS beam-splitter reduce speckles noise of said optical self-mix signal; wherein the speckles noise reducer further comprises a calibration unit, to check an effect of at least two timing schemes on speckles noise reduction, and to select a particular timing scheme that provides a greater reduction in speckles noise.

In some embodiments, the system comprises a movable Micro-Electro-Mechanical Systems (MEMS) beam-splitter that is co-located in proximity to said laser transmitter and to said self-mix interferometry unit, to split one or more laser beams generated by said laser transmitter; wherein the speckles noise reducer comprises a beam-splitter displacement controller to selectively cause said movable MEMS beam-splitter to move in a non-vibrating pattern, wherein displacement of said movable beam-splitter reduces speckles noise of said optical self-mix signal.

In some embodiments, the system comprises a movable Micro-Electro-Mechanical Systems (MEMS) beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause only said movable MEMS beam-splitter to vibrate, wherein other components of the laser microphone are maintained non-vibrating; wherein vibrations of said movable MEMS beam-splitter reduce speckles noise of said optical self-mix signal.

In some embodiments, the system comprises a movable beam-steering unit that is co-located in proximity to said laser transmitter and to said self-mix interferometry unit, to steer one or more laser beams generated by said laser transmitter; wherein the speckles noise reducer comprises a beam-steering unit vibration controller to selectively cause said movable beam-steering unit to vibrate, wherein vibrations of said movable beam-steering unit reduce speckles noise of said optical self-mix signal.

In some embodiments, the system comprises a movable beam-steering unit that is co-located in proximity to said laser transmitter and to said self-mix interferometry unit, to steer one or more laser beams generated by said laser transmitter; wherein the speckles noise reducer comprises a beam-steering unit vibration controller to selectively cause said movable beam-steering unit to vibrate based on a pseudo-random vibration pattern, wherein vibrations of said movable beam-steering unit reduce speckles noise of said optical self-mix signal.

In some embodiments, the system comprises a movable beam-steering unit that is co-located in proximity to said laser transmitter and to said self-mix interferometry unit, to steer one or more laser beams generated by said laser transmitter; wherein the speckles noise reducer comprises a beam-steering unit vibration controller to selectively cause said movable beam-steering unit to vibrate based on a pre-defined timing scheme, wherein vibrations of said movable beam-steering unit reduce speckles noise of said optical self-mix signal.

In some embodiments, the system comprises a movable beam-steering unit that is co-located in proximity to said laser transmitter and to said self-mix interferometry unit, to steer one or more laser beams generated by said laser transmitter; wherein the speckles noise reducer comprises a beam-steering unit vibration controller to selectively cause said movable beam-steering unit to vibrate based on a pre-defined timing scheme, wherein vibrations of said movable beam-steering unit reduce speckles noise of said optical self-mix signal; wherein the speckles noise reducer further comprises a calibration unit, to check an effect of at least two timing schemes on speckles noise reduction, and to select a particular timing scheme that provides a greater reduction in speckles noise.

In some embodiments, the system comprises a movable beam-steering unit that is co-located in proximity to said laser transmitter and to said self-mix interferometry unit, to steer one or more laser beams generated by said laser transmitter; wherein the speckles noise reducer comprises a beam-steering unit displacement controller to selectively cause said movable beam-steering unit to move in a non-vibrating pattern, wherein displacement of said movable beam-steering unit reduces speckles noise of said optical self-mix signal.

In some embodiments, the system comprises a movable beam-steering unit that is co-located in proximity to said laser transmitter and to said self-mix interferometry unit, to steer one or more laser beams generated by said laser transmitter; wherein the speckles noise reducer comprises a beam-steering unit vibration controller to selectively cause only said movable beam-steering unit to vibrate, wherein other components of the laser microphone are maintained non-vibrating; wherein vibrations of said movable beam-steering unit reduce speckles noise of said optical self-mix signal.

In some embodiments, the system comprises a movable Micro-Electro-Mechanical Systems (MEMS) beam-steering unit that is co-located in proximity to said laser transmitter and to said self-mix interferometry unit, to steer one or more laser beams generated by said laser transmitter; wherein the speckles noise reducer comprises a beam-steering unit vibration controller to selectively cause said movable MEMS beam-steering unit to vibrate, wherein vibrations of said movable MEMS beam-steering unit reduce speckles noise of said optical self-mix signal.

In some embodiments, the system comprises a movable Micro-Electro-Mechanical Systems (MEMS) beam-steering unit that is co-located in proximity to said laser transmitter and to said self-mix interferometry unit, to steer one or more laser beams generated by said laser transmitter; wherein the speckles noise reducer comprises a beam-steering unit vibration controller to selectively cause said movable MEMS beam-steering unit to vibrate based on a pseudo-random vibration pattern, wherein vibrations of said movable MEMS beam-steering unit reduce speckles noise of said optical self-mix signal.

In some embodiments, the system comprises a movable Micro-Electro-Mechanical Systems (MEMS) beam-steering unit that is co-located in proximity to said laser transmitter and to said self-mix interferometry unit, to steer one or more laser beams generated by said laser transmitter; wherein the speckles noise reducer comprises a beam-steering unit vibration controller to selectively cause said movable MEMS beam-steering unit to vibrate based on a pre-defined timing scheme, wherein vibrations of said movable MEMS beam-steering unit reduce speckles noise of said optical self-mix signal.

In some embodiments, the system comprises a movable Micro-Electro-Mechanical Systems (MEMS) beam-steering unit that is co-located in proximity to said laser transmitter and to said self-mix interferometry unit, to steer one or more laser beams generated by said laser transmitter; wherein the speckles noise reducer comprises a beam-steering unit vibration controller to selectively cause said movable MEMS beam-steering unit to vibrate based on a pre-defined timing scheme, wherein vibrations of said movable MEMS beam-steering unit reduce speckles noise of said optical self-mix signal; wherein the speckles noise reducer further comprises a calibration unit, to check an effect of at least two timing schemes on speckles noise reduction, and to select a particular timing scheme that provides a greater reduction in speckles noise.

In some embodiments, the system comprises a movable Micro-Electro-Mechanical Systems (MEMS) beam-steering unit that is co-located in proximity to said laser transmitter and to said self-mix interferometry unit, to steer one or more laser beams generated by said laser transmitter; wherein the speckles noise reducer comprises a beam-steering unit displacement controller to selectively cause said movable MEMS beam-steering unit to move in a non-vibrating pattern, wherein displacement of said movable MEMS beam-steering unit reduces speckles noise of said optical self-mix signal.

In some embodiments, the system comprises a movable Micro-Electro-Mechanical Systems (MEMS) beam-steering unit that is co-located in proximity to said laser transmitter and to said self-mix interferometry unit, to steer one or more laser beams generated by said laser transmitter; wherein the speckles noise reducer comprises a beam-steering unit vibration controller to selectively cause only said movable MEMS beam-steering unit to vibrate, wherein other components of the laser microphone are maintained non-vibrating; wherein vibrations of said movable MEMS beam-steering unit reduce speckles noise of said optical self-mix signal.

In some embodiments, the system comprises a movable Micro-Electro-Mechanical Systems (MEMS) mirror that is co-located in proximity to said laser transmitter and to said self-mix interferometry unit; wherein the speckles noise reducer comprises a mirror vibration controller to selectively cause said movable mirror to vibrate, wherein vibrations of said mirror reduce speckles noise of said optical self-mix signal.

In some embodiments, the system comprises a movable MEMS mirror that is co-located in proximity to said laser transmitter and to said self-mix interferometry unit; wherein the speckles noise reducer comprises a mirror vibration controller to selectively cause said movable MEMS mirror to vibrate based on a pseudo-random vibration pattern, wherein vibrations of said movable MEMS mirror reduce speckles noise of said optical self-mix signal.

In some embodiments, the system comprises a movable MEMS mirror that is co-located in proximity to said laser transmitter and to said self-mix interferometry unit; wherein the speckles noise reducer comprises a mirror vibration controller to selectively cause said movable MEMS mirror to vibrate based on a pre-defined timing scheme, wherein vibrations of said movable MEMS mirror reduce speckles noise of said optical self-mix signal.

In some embodiments, the system comprises a movable MEMS mirror that is co-located in proximity to said laser transmitter and to said self-mix interferometry unit; wherein the speckles noise reducer comprises a mirror vibration controller to selectively cause said movable MEMS mirror to vibrate based on a pre-defined timing scheme, wherein vibrations of said movable MEMS mirror reduce speckles noise of said optical self-mix signal; wherein the speckles noise reducer further comprises a calibration unit, to check an effect of at least two timing schemes on speckles noise reduction, and to select a particular timing scheme that provides a greater reduction in speckles noise.

In some embodiments, the system comprises a movable MEMS mirror that is co-located in proximity to said laser transmitter and to said self-mix interferometry unit; wherein the speckles noise reducer comprises a mirror displacement controller to selectively cause said movable MEMS mirror to move in a non-vibrating pattern, wherein displacement of said movable MEMS mirror reduces speckles noise of said optical self-mix signal.

In some embodiments, the system comprises a movable Micro-Electro-Mechanical Systems (MEMS) mirror that is co-located in proximity to said laser transmitter and to said self-mix interferometry unit; wherein the speckles noise reducer comprises a mirror vibration controller to selectively cause only said movable MEMS mirror to vibrate, wherein other components of the laser microphone are maintained non-vibrating; wherein vibrations of said movable MEMS mirror reduce speckles noise of said optical self-mix signal.

In some embodiments, the speckles noise reducer comprises a self-mix dynamic modulation modifier unit, to dynamically modify a modulation of said laser transmitter, wherein modulation of said laser transmitter reduces speckles noise of said optical self-mix signal.

In some embodiments, the speckles noise reducer comprises a self-mix dynamic modulation modifier unit, to dynamically modify a modulation of said laser transmitter in accordance with a pre-defined timing scheme; wherein modulation of said laser transmitter in accordance with said pre-defined timing scheme reduces speckles noise of said optical self-mix signal.

In some embodiments, the speckles noise reducer comprises a self-mix dynamic modulation modifier unit, to dynamically modify a modulation of said laser transmitter in accordance with a pre-defined timing scheme; wherein modulation of said laser transmitter in accordance with said pre-defined timing scheme reduces speckles noise of said optical self-mix signal; wherein the speckles noise reducer further comprises a calibration unit, to check an effect of at least two timing schemes on speckles noise reduction, and to select a particular timing scheme that provides a greater reduction in speckles noise.

In some embodiments, the speckles noise reducer comprises a self-mix dynamic modulation modifier unit, to dynamically modify a modulation of said laser transmitter in accordance with a pseudo-random modification scheme; wherein modulation of said laser transmitter in accordance with said pseudo-random modification scheme reduces speckles noise of said optical self-mix signal.

In some embodiments, the speckles noise reducer comprises a self-mix dynamic modulation modifier unit, to dynamically modify a modulation of said laser transmitter, wherein modulation of said laser transmitter reduces speckles noise of said optical self-mix signal; wherein the self-mix dynamic modulation modifier unit comprises a temperature modifier unit to dynamically modify an operating temperature of a laser modulator of said laser transmitter.

In some embodiments, the speckles noise reducer comprises a self-mix dynamic modulation modifier unit, to dynamically modify a modulation of said laser transmitter in accordance with a pre-defined timing scheme; wherein modulation of said laser transmitter in accordance with said pre-defined timing scheme reduces speckles noise of said optical self-mix signal; wherein the self-mix dynamic modulation modifier unit comprises a temperature modifier unit to dynamically modify an operating temperature of a laser modulator of said laser transmitter; wherein modification of the operating temperature of said laser modulator causes modification of said modulation of said laser transmitter.

In some embodiments, the speckles noise reducer comprises a self-mix dynamic modulation modifier unit, to dynamically modify a modulation of said laser transmitter in accordance with a pre-defined timing scheme; wherein modulation of said laser transmitter in accordance with said pre-defined timing scheme reduces speckles noise of said optical self-mix signal; wherein the speckles noise reducer further comprises a calibration unit, to check an effect of at least two timing schemes on speckles noise reduction, and to select a particular timing scheme that provides a greater reduction in speckles noise; wherein the self-mix dynamic modulation modifier unit comprises a temperature modifier unit to dynamically modify an operating temperature of a laser modulator of said laser transmitter; wherein modification of the operating temperature of said laser modulator causes modification of said modulation of said laser transmitter.

In some embodiments, the speckles noise reducer comprises a self-mix dynamic modulation modifier unit, to dynamically modify a modulation of said laser transmitter in accordance with a pseudo-random modification scheme; wherein modulation of said laser transmitter in accordance with said pseudo-random modification scheme reduces speckles noise of said optical self-mix signal; wherein the self-mix dynamic modulation modifier unit comprises a temperature modifier unit to dynamically modify an operating temperature of a laser modulator of said laser transmitter; wherein modification of the operating temperature of said laser modulator causes modification of said modulation of said laser transmitter.

In some embodiments, the system comprises a movable beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable beam-splitter to vibrate, wherein vibrations of said movable beam-splitter reduce speckles noise of said optical self-mix signal; wherein the speckles noise reducer further comprises a self-mix dynamic modulation modifier unit, to dynamically modify a modulation of said laser transmitter, wherein modulation of said laser transmitter further reduces speckles noise of said optical self-mix signal.

In some embodiments, the system comprises a movable Micro-Electro-Mechanical Systems (MEMS) beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable MEMS beam-splitter to vibrate, wherein vibrations of said movable MEMS beam-splitter reduce speckles noise of said optical self-mix signal; wherein the speckles noise reducer further comprises a self-mix dynamic modulation modifier unit, to dynamically modify a modulation of said laser transmitter, wherein modulation of said laser transmitter further reduces speckles noise of said optical self-mix signal.

In some embodiments, the system comprises a self-mix signal quality estimator, (I) to estimate the bandwidth of the self-mix signal, and (b) if the bandwidth of the self-mix signal is lower than a threshold value, to trigger activation of the speckles noise reducer.

In some embodiments, the system comprises a self-mix signal quality estimator, (I) to estimate the bandwidth of the self-mix signal, and (b) if the bandwidth of the self-mix signal is greater than a threshold value, to trigger de-activation of the speckles noise reducer.

In some embodiments, the system comprises: a movable beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable beam-splitter to vibrate, wherein vibrations of said movable beam-splitter reduce speckles noise of said optical self-mix signal; a self-mix signal quality estimator, (I) to estimate the bandwidth of the self-mix signal, and (b) if the bandwidth of the self-mix signal is lower than a threshold value, to trigger activation of the beam-splitter vibration controller of the speckles noise reducer.

In some embodiments, the system comprises: a movable beam-splitter that is co-located in proximity to said laser transmitter and to said self-mix interferometry unit, to split one or more laser beams generated by said laser transmitter; wherein the speckles noise reducer comprises a beam-splitter vibration controller to selectively cause said movable beam-splitter to vibrate, wherein vibrations of said movable beam-splitter reduce speckles noise of said optical self-mix signal; a self-mix signal quality estimator, (I) to estimate the bandwidth of the self-mix signal, and (b) if the bandwidth of the self-mix signal is greater than a threshold value, to trigger de-activation of the beam-splitter vibration controller of the speckles noise reducer.

In some embodiments, the speckles noise reducer comprises a self-mix dynamic modulation modifier unit, to dynamically modify a modulation of said laser transmitter, wherein modulation of said laser transmitter reduces speckles noise of said optical self-mix signal; wherein the system comprises a self-mix signal quality estimator, (I) to estimate the bandwidth of the self-mix signal, and (b) if the bandwidth of the self-mix signal is lower than a threshold value, to trigger activation of the self-mix dynamic modulation modifier unit of the speckles noise reducer.

In some embodiments, the speckles noise reducer comprises a self-mix dynamic modulation modifier unit, to dynamically modify a modulation of said laser transmitter, wherein modulation of said laser transmitter reduces speckles noise of said optical self-mix signal; wherein the system comprises a self-mix signal quality estimator, (I) to estimate the bandwidth of the self-mix signal, and (b) if the bandwidth of the self-mix signal is greater than a threshold value, to trigger de-activation of the self-mix dynamic modulation modifier unit of the speckles noise reducer.

In some embodiments, the system further comprises at least one acoustic microphone; wherein the system is a hybrid acoustic-and-optical sensor.

In some embodiments, the system further comprises at least one acoustic microphone; wherein the system is a hybrid acoustic-and-optical sensor which is comprised in a device selected from the group consisting of: a laptop computer, a smartphone, a tablet, a portable electronic device, a vehicular audio system.

The present invention may comprise systems and devices that include a laser microphone or laser-based microphone or optical microphone. For example, the laser microphone includes a laser transmitter to transmit an outgoing laser beam towards a face of a human speaker. The laser transmitter acts also as a self-mix interferometry unit that receives the optical feedback signal reflected from the face of the human speaker, and generates an optical self-mix signal by self-mixing interferometry of the laser power and the received optical feedback signal; and a speckles noise reducer to reduce speckles noise and to increase a bandwidth of the optical self-mix signal. The speckles noise reducer optionally includes a vibration unit or displacement unit, to cause vibrations or displacement of one or more mirrors or optics elements of the laser microphone, to thereby reduce speckles noise. The speckles noise reducer optionally includes a dynamic laser modulation modifier unit, to dynamically modify modulation properties of a laser modulator associated with the laser transmitter; optionally by modifying an operating temperature of the laser. Optionally, modifications are performed based on a timing scheme, or based on a pseudo-random scheme, or based on a calibration process that selects an advantageous modification scheme. Optionally, the system detects self-mix signal magnitude or bandwidth or quality, and activates the speckles noise reduction mechanism if the self-mix signal appears to be weak or low-quality.

Functions, operations, components and/or features described herein with reference to one or more embodiments of the present invention, may be combined with, or may be utilized in combination with, one or more other functions, operations, components and/or features described herein with reference to one or more other embodiments of the present invention. The present invention may thus comprise any possible or suitable combinations, re-arrangements, assembly, re-assembly, or other utilization of some or all of the modules or functions or components that are described herein, even if they are discussed in different locations or different chapters of the above discussion, or even if they are shown across different drawings or multiple drawings.

While certain features of some demonstrative embodiments of the present invention have been illustrated and described herein, various modifications, substitutions, changes, and equivalents may occur to those skilled in the art. Accordingly, the claims are intended to cover all such modifications, substitutions, changes, and equivalents.

The invention claimed is:

1. A system comprising:

a laser microphone comprising:

(a) a self-mix interferometry unit, (i) to transmit via a laser transmitter an outgoing laser beam towards a face of the human speaker, and (ii) to receive an optical feedback signal reflected from the face of the human speaker, and (iii) to generate an optical self-mix signal by self-mixing interferometry of the laser power and the received optical feedback signal;

(b) a speckles noise reducer to reduce speckles noise and to increase a bandwidth of said optical self-mix signal;

wherein the speckles noise reducer comprises a self-mix dynamic modulation modifier unit, to dynamically modify a modulation of said laser transmitter, wherein modulation of said laser transmitter reduces speckles noise of said optical self-mix signal.

2. The system of claim 1, wherein the system comprises a movable beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable beam-splitter to vibrate, wherein vibrations of said movable beam-splitter reduce speckles noise of said optical self-mix signal.

3. The system of claim 1, wherein the system comprises a movable beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable beam-splitter to vibrate based on a pre-defined timing scheme, wherein vibrations of said movable beam-splitter reduce speckles noise of said optical self-mix signal.

4. The system of claim 1, wherein the system comprises a movable beam-splitter that is co-located in proximity to said laser transmitter and to said self-mix interferometry unit, to split one or more laser beams generated by said laser transmitter;

wherein the speckles noise reducer comprises a beam-splitter displacement controller to selectively cause said movable beam-splitter to move in a non-vibrating pattern, wherein displacement of said movable beam-splitter reduces speckles noise of said optical self-mix signal.

5. The system of claim 1, wherein the system comprises a movable Micro-Electro-Mechanical Systems (MEMS) beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable MEMS beam-splitter to vibrate, wherein vibrations of said movable MEMS beam-splitter reduce speckles noise of said optical self-mix signal.

6. The system of claim 1, wherein the system comprises a movable Micro-Electro-Mechanical Systems (MEMS) beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable MEMS beam-splitter to vibrate based on a pre-defined timing scheme, wherein vibrations of said movable MEMS beam-splitter reduce speckles noise of said optical self-mix signal.

7. The system of claim 1, wherein the system comprises a movable Micro-Electro-Mechanical Systems (MEMS) beam-splitter that is co-located in proximity to said laser transmitter and to said self-mix interferometry unit, to split one or more laser beams generated by said laser transmitter;

wherein the speckles noise reducer comprises a beam-splitter displacement controller to selectively cause said movable MEMS beam-splitter to move in a non-vibrating pattern, wherein displacement of said movable beam-splitter reduces speckles noise of said optical self-mix signal.

8. The system of claim 1, wherein the system comprises a movable beam-steering unit that is co-located in proximity to said laser transmitter and to said self-mix interferometry unit, to steer one or more laser beams generated by said laser transmitter;

wherein the speckles noise reducer comprises a beam-steering unit vibration controller to selectively cause said movable beam-steering unit to vibrate based on a pseudo-random vibration pattern, wherein vibrations of said movable beam-steering unit reduce speckles noise of said optical self-mix signal.

9. The system of claim 1, wherein the system comprises a movable beam-steering unit that is co-located in proximity to said laser transmitter and to said self-mix interferometry unit, to steer one or more laser beams generated by said laser transmitter;

wherein the speckles noise reducer comprises a beam-steering unit vibration controller to selectively cause said movable beam-steering unit to vibrate based on a pre-defined timing scheme, wherein vibrations of said movable beam-steering unit reduce speckles noise of said optical self-mix signal;

wherein the speckles noise reducer further comprises a calibration unit, to check an effect of at least two timing schemes on speckles noise reduction, and to select a particular timing scheme that provides a greater reduction in speckles noise.

10. The system of claim 1, wherein the system comprises a movable beam-steering unit that is co-located in proximity to said laser transmitter and to said self-mix interferometry unit, to steer one or more laser beams generated by said laser transmitter;

wherein the speckles noise reducer comprises a beam-steering unit vibration controller to selectively cause only said movable beam-steering unit to vibrate, wherein other components of the laser microphone are maintained non-vibrating; wherein vibrations of said movable beam-steering unit reduce speckles noise of said optical self-mix signal.

11. The system of claim 1, wherein the system comprises a movable Micro-Electro-Mechanical Systems (MEMS) beam-steering unit that is co-located in proximity to said laser transmitter and to said self-mix interferometry unit, to steer one or more laser beams generated by said laser transmitter;

wherein the speckles noise reducer comprises a beam-steering unit vibration controller to selectively cause said movable MEMS beam-steering unit to vibrate based on a pseudo-random vibration pattern, wherein vibrations of said movable MEMS beam-steering unit reduce speckles noise of said optical self-mix signal.

12. The system of claim 1, wherein the system comprises a movable Micro-Electro-Mechanical Systems (MEMS) beam-steering unit that is co-located in proximity to said laser transmitter and to said self-mix interferometry unit, to steer one or more laser beams generated by said laser transmitter;

wherein the speckles noise reducer comprises a beam-steering unit vibration controller to selectively cause said movable MEMS beam-steering unit to vibrate based on a pre-defined timing scheme, wherein vibrations of said movable MEMS beam-steering unit reduce speckles noise of said optical self-mix signal;

wherein the speckles noise reducer further comprises a calibration unit, to check an effect of at least two timing schemes on speckles noise reduction, and to select a particular timing scheme that provides a greater reduction in speckles noise.

13. The system of claim 1, wherein the system comprises a movable Micro-Electro-Mechanical Systems (MEMS) beam-steering unit that is co-located in proximity to said laser transmitter and to said self-mix interferometry unit, to steer one or more laser beams generated by said laser transmitter;

wherein the speckles noise reducer comprises a beam-steering unit vibration controller to selectively cause only said movable MEMS beam-steering unit to vibrate, wherein other components of the laser microphone are maintained non-vibrating; wherein vibrations of said movable MEMS beam-steering unit reduce speckles noise of said optical self-mix signal.

14. The system of claim 1, wherein the system comprises a movable MEMS mirror that is co-located in proximity to said laser transmitter and to said self-mix interferometry unit;

wherein the speckles noise reducer comprises a mirror vibration controller to selectively cause said movable MEMS mirror to vibrate based on a pseudo-random vibration pattern, wherein vibrations of said movable MEMS mirror reduce speckles noise of said optical self-mix signal.

15. The system of claim 1, wherein the system comprises a movable MEMS mirror that is co-located in proximity to said laser transmitter and to said self-mix interferometry unit;

wherein the speckles noise reducer comprises a mirror vibration controller to selectively cause said movable MEMS mirror to vibrate based on a pre-defined timing scheme, wherein vibrations of said movable MEMS mirror reduce speckles noise of said optical self-mix signal;

wherein the speckles noise reducer further comprises a calibration unit, to check an effect of at least two timing schemes on speckles noise reduction, and to select a particular timing scheme that provides a greater reduction in speckles noise.

16. The system of claim 1, wherein the system comprises a movable Micro-Electro-Mechanical Systems (MEMS) mirror that is co-located in proximity to said laser transmitter and to said self-mix interferometry unit;

wherein the speckles noise reducer comprises a mirror vibration controller to selectively cause only said movable MEMS mirror to vibrate, wherein other components of the laser microphone are maintained non-vibrating; wherein vibrations of said movable MEMS mirror reduce speckles noise of said optical self-mix signal.

17. The system of claim 1, wherein the self-mix dynamic modulation modifier unit is to dynamically modify the modulation of said laser transmitter in accordance with a pre-defined timing scheme, wherein modulation of said laser transmitter in accordance with said pre-defined timing scheme reduces speckles noise of said optical self-mix signal.

18. The system of claim 1, wherein the self-mix dynamic modulation modifier unit is to dynamically modify the modulation of said laser transmitter in accordance with a pre-defined timing scheme, wherein modulation of said laser transmitter in accordance with said pre-defined timing scheme reduces speckles noise of said optical self-mix signal;

wherein the speckles noise reducer further comprises a calibration unit, to check an effect of at least two timing schemes on speckles noise reduction, and to select a particular timing scheme that provides a greater reduction in speckles noise.

19. The system of claim 1, wherein the self-mix dynamic modulation modifier unit is to dynamically modify the modulation of said laser transmitter in accordance with a pseudo-random modification scheme, wherein modulation of said laser transmitter in accordance with said pseudo-random modification scheme reduces speckles noise of said optical self-mix signal.

20. The system of claim 1, wherein the self-mix dynamic modulation modifier unit is to dynamically modify the modulation of said laser transmitter, wherein modulation of said laser transmitter reduces speckles noise of said optical self-mix signal;

wherein the self-mix dynamic modulation modifier unit comprises a temperature modifier unit to dynamically modify an operating temperature of a laser modulator of said laser transmitter.

21. The system of claim 1, wherein the self-mix dynamic modulation modifier unit is to dynamically modify the modulation of said laser transmitter in accordance with a pre-defined timing scheme, wherein modulation of said laser transmitter in accordance with said pre-defined timing scheme reduces speckles noise of said optical self-mix signal;

wherein the self-mix dynamic modulation modifier unit comprises a temperature modifier unit to dynamically modify an operating temperature of a laser modulator of said laser transmitter; wherein modification of the operating temperature of said laser modulator causes modification of said modulation of said laser transmitter.

22. The system of claim 1, wherein the self-mix dynamic modulation modifier unit is to dynamically modify the modulation of said laser transmitter in accordance with a pre-defined timing scheme, wherein modulation of said laser transmitter in accordance with said pre-defined timing scheme reduces speckles noise of said optical self-mix signal;

wherein the speckles noise reducer further comprises a calibration unit, to check an effect of at least two timing schemes on speckles noise reduction, and to select a particular timing scheme that provides a greater reduction in speckles noise;

wherein the self-mix dynamic modulation modifier unit comprises a temperature modifier unit to dynamically modify an operating temperature of a laser modulator of said laser transmitter; wherein modification of the operating temperature of said laser modulator causes modification of said modulation of said laser transmitter.

23. The system of claim 1, wherein the self-mix dynamic modulation modifier unit is to dynamically modify the modulation of said laser transmitter in accordance with a pseudo-random modification scheme, wherein modulation of said laser transmitter in accordance with said pseudo-random modification scheme reduces speckles noise of said optical self-mix signal;

wherein the self-mix dynamic modulation modifier unit comprises a temperature modifier unit to dynamically modify an operating temperature of a laser modulator of said laser transmitter; wherein modification of the operating temperature of said laser modulator causes modification of said modulation of said laser transmitter.

24. The system of claim 1, wherein the system comprises a movable Micro-Electro-Mechanical Systems (MEMS) beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable MEMS beam-splitter to vibrate, wherein vibrations of said movable MEMS beam-splitter reduce speckles noise of said optical self-mix signal;

wherein the speckles noise reducer further comprises a self-mix dynamic modulation modifier unit, to dynamically modify a modulation of said laser transmitter, wherein modulation of said laser transmitter further reduces speckles noise of said optical self-mix signal.

25. The system of claim 1, comprising:

a self-mix signal quality estimator, (I) to estimate the bandwidth of the self-mix signal, and (b) if the bandwidth of the self-mix signal is greater than a threshold value, to trigger de-activation of the speckles noise reducer.

26. The system of claim 1, comprising:

a movable beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable beam-splitter to vibrate, wherein vibrations of said movable beam-splitter reduce speckles noise of said optical self-mix signal, a self-mix signal quality estimator, (I) to estimate the bandwidth of the self-mix signal, and (b) if the bandwidth of the self-mix signal is lower than a threshold value, to trigger activation of the beam-splitter vibration controller of the speckles noise reducer.

27. The system of claim 1, comprising:

a movable beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable beam-splitter to vibrate, wherein vibrations of said movable beam-splitter reduce speckles noise of said optical self-mix signal;

a self-mix signal quality estimator, (I) to estimate the bandwidth of the self-mix signal, and (b) if the bandwidth of the self-mix signal is greater than a threshold value, to trigger de-activation of the beam-splitter vibration controller of the speckles noise reducer.

28. The system of claim 1, further comprising at least one acoustic microphone;

wherein the system is a hybrid acoustic-and-optical sensor.

29. A system comprising:

a laser microphone comprising:

(a) a self-mix interferometry unit, (i) to transmit via a laser transmitter an outgoing laser beam towards a face of the human speaker, and (ii) to receive an optical feedback signal reflected from the face of the human speaker, and (iii) to generate an optical self-mix signal by self-mixing interferometry of the laser power and the received optical feedback signal;

(b) a speckles noise reducer to reduce speckles noise and to increase a bandwidth of said optical self-mix signal;

(c) a self-mix signal quality estimator, (I) to estimate the bandwidth of the self-mix signal, and (b) if the bandwidth of the self-mix signal is lower than a threshold value, to trigger activation of the speckles noise reducer.

30. The system of claim 29, wherein the system comprises a movable beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable beam-splitter to vibrate based on a pseudo-random vibration pattern, wherein vibrations of said movable beam-splitter reduce speckles noise of said optical self-mix signal.

31. The system of claim 29, wherein the system comprises a movable beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable beam-splitter to vibrate based on a pre-defined timing scheme, wherein vibrations of said movable beam-splitter reduce speckles noise of said optical self-mix signal;

wherein the speckles noise reducer further comprises a calibration unit, to check an effect of at least two timing schemes on speckles noise reduction, and to select a particular timing scheme that provides a greater reduction in speckles noise.

32. The system of claim 29, wherein the system comprises a movable beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause only said movable beam-splitter to vibrate, wherein other components of the laser microphone are maintained non-vibrating; wherein vibrations of said movable beam-splitter reduce speckles noise of said optical self-mix signal.

33. The system of claim 29, wherein the system comprises a movable Micro-Electro-Mechanical Systems (MEMS) beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable MEMS beam-splitter to vibrate based on a pseudo-random vibration pattern, wherein vibrations of said movable MEMS beam-splitter reduce speckles noise of said optical self-mix signal.

34. The system of claim 29, wherein the system comprises a movable Micro-Electro-Mechanical Systems (MEMS) beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable MEMS beam-splitter to vibrate based on a pre-defined timing scheme, wherein vibrations of said movable MEMS beam-splitter reduce speckles noise of said optical self-mix signal;

wherein the speckles noise reducer further comprises a calibration unit, to check an effect of at least two timing schemes on speckles noise reduction, and to select a particular timing scheme that provides a greater reduction in speckles noise.

35. The system of claim 29, wherein the system comprises a movable Micro-Electro-Mechanical Systems (MEMS) beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause only said movable MEMS beam-splitter to vibrate, wherein other components of the laser microphone are maintained non-vibrating; wherein vibrations of said movable MEMS beam-splitter reduce speckles noise of said optical self-mix signal.

36. The system of claim 29, wherein the system comprises a movable beam-steering unit that is co-located in proximity to said laser transmitter and to said self-mix interferometry unit, to steer one or more laser beams generated by said laser transmitter;

wherein the speckles noise reducer comprises a beam-steering unit vibration controller to selectively cause said movable beam-steering unit to vibrate based on a pre-defined timing scheme, wherein vibrations of said movable beam-steering unit reduce speckles noise of said optical self-mix signal.

37. The system of claim 29, wherein the system comprises a movable beam-steering unit that is co-located in proximity to said laser transmitter and to said self-mix interferometry unit, to steer one or more laser beams generated by said laser transmitter;

wherein the speckles noise reducer comprises a beam-steering unit displacement controller to selectively cause said movable beam-steering unit to move in a non-vibrating pattern, wherein displacement of said movable beam-steering unit reduces speckles noise of said optical self-mix signal.

38. The system of claim 29, wherein the system comprises a movable Micro-Electro-Mechanical Systems (MEMS) beam-steering unit that is co-located in proximity to said laser transmitter and to said self-mix interferometry unit, to steer one or more laser beams generated by said laser transmitter;

wherein the speckles noise reducer comprises a beam-steering unit vibration controller to selectively cause said movable MEMS beam-steering unit to vibrate, wherein vibrations of said movable MEMS beam-steering unit reduce speckles noise of said optical self-mix signal.

39. The system of claim 29, wherein the system comprises a movable Micro-Electro-Mechanical Systems (MEMS) beam-steering unit that is co-located in proximity to said laser transmitter and to said self-mix interferometry unit, to steer one or more laser beams generated by said laser transmitter;

wherein the speckles noise reducer comprises a beam-steering unit vibration controller to selectively cause said movable MEMS beam-steering unit to vibrate based on a pre-defined timing scheme, wherein vibrations of said movable MEMS beam-steering unit reduce speckles noise of said optical self-mix signal.

40. The system of claim 29, wherein the system comprises a movable Micro-Electro-Mechanical Systems (MEMS) beam-steering unit that is co-located in proximity to said laser transmitter and to said self-mix interferometry unit, to steer one or more laser beams generated by said laser transmitter;

wherein the speckles noise reducer comprises a beam-steering unit displacement controller to selectively cause said movable MEMS beam-steering unit to move in a non-vibrating pattern, wherein displacement of said movable MEMS beam-steering unit reduces speckles noise of said optical self-mix signal.

41. The system of claim 29, wherein the system comprises a movable Micro-Electro-Mechanical Systems (MEMS) mirror that is co-located in proximity to said laser transmitter and to said self-mix interferometry unit;

wherein the speckles noise reducer comprises a mirror vibration controller to selectively cause said movable mirror to vibrate, wherein vibrations of said mirror reduce speckles noise of said optical self-mix signal.

42. The system of claim 29, wherein the system comprises a movable MEMS mirror that is co-located in proximity to said laser transmitter and to said self-mix interferometry unit;

wherein the speckles noise reducer comprises a mirror vibration controller to selectively cause said movable MEMS mirror to vibrate based on a pre-defined timing scheme, wherein vibrations of said movable MEMS mirror reduce speckles noise of said optical self-mix signal.

43. The system of claim 29, wherein the system comprises a movable MEMS mirror that is co-located in proximity to said laser transmitter and to said self-mix interferometry unit;

wherein the speckles noise reducer comprises a mirror displacement controller to selectively cause said movable MEMS mirror to move in a non-vibrating pattern, wherein displacement of said movable MEMS mirror reduces speckles noise of said optical self-mix signal.

44. The system of claim 29, wherein the system comprises a movable beam-splitter that is co-located in proximity to said laser transmitter and to said self-mix interferometry unit, to split one or more laser beams generated by said laser transmitter;

wherein the speckles noise reducer comprises a beam-splitter vibration controller to selectively cause said movable beam-splitter to vibrate, wherein vibrations of said movable beam-splitter reduce speckles noise of said optical self-mix signal;

wherein the speckles noise reducer further comprises a self-mix dynamic modulation modifier unit, to dynamically modify a modulation of said laser transmitter, wherein modulation of said laser transmitter further reduces speckles noise of said optical self-mix signal.

45. The system of claim 29, further comprising at least one acoustic microphone;

wherein the system is a hybrid acoustic-and-optical sensor which is comprised in a device selected from the group consisting of: a laptop computer, a smartphone, a tablet, a portable electronic device, a vehicular audio system.

46. A system comprising:

a laser microphone comprising:

(a) a self-mix interferometry unit, (i) to transmit via a laser transmitter an outgoing laser beam towards a face of the human speaker, and (ii) to receive an optical feedback signal reflected from the face of the human speaker, and (iii) to generate an optical self-mix signal by self-mixing interferometry of the laser power and the received optical feedback signal;

(b) a speckles noise reducer to reduce speckles noise and to increase a bandwidth of said optical self-mix signal;

wherein the system comprises a movable beam-steering unit that is co-located in proximity to said laser transmitter and to said self-mix interferometry unit, to steer one or more laser beams generated by said laser transmitter;

wherein the speckles noise reducer comprises a beam-steering unit vibration controller to selectively cause said movable beam-steering unit to vibrate, wherein vibrations of said movable beam-steering unit reduce speckles noise of said optical self-mix signal.

47. The system of claim 46, wherein the speckles noise reducer comprises a self-mix dynamic modulation modifier unit, to dynamically modify a modulation of said laser transmitter, wherein modulation of said laser transmitter reduces speckles noise of said optical self-mix signal;

wherein the system comprises a self-mix signal quality estimator, (I) to estimate the bandwidth of the self-mix signal, and (b) if the bandwidth of the self-mix signal is lower than a threshold value, to trigger activation of the self-mix dynamic modulation modifier unit of the speckles noise reducer.

48. The system of claim 46, wherein the speckles noise reducer comprises a self-mix dynamic modulation modifier unit, to dynamically modify a modulation of said laser transmitter, wherein modulation of said laser transmitter reduces speckles noise of said optical self-mix signal;

wherein the system comprises a self-mix signal quality estimator, (I) to estimate the bandwidth of the self-mix signal, and (b) if the bandwidth of the self-mix signal is greater than a threshold value, to trigger de-activation of the self-mix dynamic modulation modifier unit of the speckles noise reducer.

* * * * *